US006637857B2

(12) United States Patent
Shimizu et al.

(10) Patent No.: US 6,637,857 B2
(45) Date of Patent: Oct. 28, 2003

(54) INK JET RECORDING APPARATUS AND CLEANING CONTROL METHOD FOR WIPING DEVICE IN THE APPARATUS

(75) Inventors: Yoshiaki Shimizu, Nagano (JP); Hitoshi Hayakawa, Nagano (JP); Norihiro Maruyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/982,875

(22) Filed: Oct. 22, 2001

(65) Prior Publication Data

US 2002/0105560 A1 Aug. 8, 2002

(30) Foreign Application Priority Data

Oct. 20, 2000 (JP) ..... 2000-320701
Feb. 26, 2001 (JP) ..... 2001-050242
Oct. 11, 2001 (JP) ..... 2001-313688

(51) Int. Cl.[7] ..... B41J 2/165

(52) U.S. Cl. ..... 347/32; 347/29; 347/30; 347/33

(58) Field of Search ..... 347/32, 29, 30, 347/33

(56) References Cited

U.S. PATENT DOCUMENTS 6,086,183 A * 7/2000 Nakahara ..... 347/30
6,151,044 A * 11/2000 Gaasch ..... 347/33

* cited by examiner

*Primary Examiner*—Shih-Wen Hsieh
(74) *Attorney, Agent, or Firm*—Sughrue Mion, PLLC

(57) ABSTRACT

A wiping member for wiping the nozzle forming surface of a recording head is mounted on a holding member and is constituted to be moved in a vertical direction. On the other hand, a capping device is provided with a wiper cleaner for abutting on the side wall of the wiping member. By the wiping operation of the recording head, a waste ink sticking to the wiping member is wiped away by the wiper cleaner with the fall of the wiping member and is removed from the wiping member.

27 Claims, 14 Drawing Sheets

INK JET RECORDING APPARATUS AND CLEANING CONTROL METHOD FOR WIPING DEVICE IN THE APPARATUS

BACKGROUND OF THE INVENTION

1. Field of the Invention

The present invention relates to a recording apparatus comprising an ink jet recording head mounted on a carriage and serving to discharge an ink drop corresponding to print data, and a wiping device for slidably coming in contact with the nozzle forming surface of the recording head to remove waste ink, and more particularly to a recording apparatus comprising a wiper cleaner for cleaning the waste ink sticking to a wiping device and a cleaning control method for wiping device in the apparatus.

2. Description of Related Art

An ink jet recording apparatus generally comprises an ink jet recording head for receiving the supply of an ink from an ink cartridge and paper feeding means for relatively moving a recording paper to the recording head, and recording is carried out by discharging an ink drop to the recording paper based on print data while moving the recording head. The recording head capable of discharging each ink such as black, yellow, cyan or magenta is mounted on a carriage, and full color print can be carried out by changing the discharge ratio of each color ink in addition to text print using a black ink.

The ink jet recording head has a problem in that since an ink pressurized in a pressure generating chamber is discharged as an ink drop to a recording paper from a nozzle to carry out printing, a printing failure is caused on the function of discharging the ink from a nozzle opening because an ink viscosity is increased, the ink is caked, a dust sticks, and furthermore, a bubble is mixed due to the evaporation of a solvent from the nozzle opening.

For this reason, the recording apparatus of this kind comprises a capping device for sealing the nozzle forming surface of a recording head during non-printing. The capping device functions as a cover member for preventing the ink of the nozzle opening in the recording head from being dried, and furthermore, has the function of sealing the nozzle forming surface by the capping device and sucking the ink from the nozzle opening by a negative pressure applied from a sucking pump, thereby eliminating the clogging state of the nozzle opening if the nozzle opening is clogged.

A process for forcibly sucking and discharging an ink which is to be carried out for eliminating the clogging state of the recording head is referred to as a cleaning operation and is executed when the printing is restarted after the apparatus is stopped for a long time or when a user recognizes a printing failure to operate a cleaning switch, for example. According to the cleaning operation, a negative pressure is applied through a sucking pump and the ink is sucked and discharged from the recording head into the capping device, and an operation for sweeping and cleaning the nozzle forming surface is then carried out by means of a wiping member formed by a rubber material, for example.

The wiping device fulfils the function of scraping a waste ink sticking to the nozzle forming surface and cleaning the nozzle forming surface with the cleaning operation, and functions to scrape a paper dust or other dusts in addition to the waste ink when the wiping member slidably comes in contact with the nozzle forming surface. Due to the repetition of the wiping operation, accordingly, the wiping member has a problem in that the waste ink is accumulated and is scattered in a comparatively large amount into the apparatus by the return function of the wiping member immediately after the wiping member goes away from the nozzle forming surface with the wiping operation.

Moreover, the waste ink sticking to the wiping member flows down along the wiping member according to gravity. Therefore, in the case in which the inside of the recording apparatus is contaminated widely by the waste ink freely flowing down from the wiping member and reaches a driving mechanism, the normal printing operation of the apparatus is blocked.

On the other hand, the waste ink sticking to the wiping member is thickened or coagulated over the wiping member with the evaporation of the solvent. In the case in which the wiping operation is carried out again in this state, the thickened substance or the coagulated substance enters a fine nozzle opening on the nozzle forming surface so that the ink drop is discharged from the nozzle opening with difficulty and a printing failure referred to as so-called dot missing is generated.

It can also be proposed that means for removing the waste ink sticking to the wiping member is removed. This means is to prevent the waste ink from being scattered when the waste ink sticking to the wiping member is to be removed.

SUMMARY OF THE INVENTION

The invention has been made to solve the problems and has an object to provide an ink jet recording apparatus capable of suppressing the generation of the printing failure and reducing the degree of contamination in the recording apparatus which is caused by the waste ink.

In order to attain the object, the invention provides an ink jet recording apparatus comprising an ink jet recording head mounted on a carriage capable of being reciprocated and serving to discharge an ink drop corresponding to print data, a capping device capable of sealing a nozzle forming surface of the recording head and sucking and discharging an ink from the recording head upon receipt of a negative pressure from a sucking pump, and a wiping device capable of cleaning the nozzle forming surface in slidable contact with the nozzle forming surface of the recording head, wherein the wiping device is constituted such that it can advance to and retreat from a moving path for the recording head, and there is provided a wiper cleaner for abutting on the wiping device and moving in a plane direction of the wiping device with advance and retreat operations of the wiping device, there by removing a waste ink sticking to the wiping device.

In this case, it is preferable that the wiper cleaner should be provided on a print region side in the capping device. On the other hand, it is preferable that the wiping device should be constituted such that it can advance and retreat in a direction orthogonal to the nozzle forming surface of the recording head with respect to the moving path for the recording head and receives the abutment of the wiper cleaner when retreating from the moving path for the recording head.

Moreover, it is desirable that the wiper cleaner should be constituted by an elastic material. In addition, it is desirable that the wiper cleaner should be constituted by a material capable of absorbing the waste ink.

In a preferred embodiment, the wiper cleaner is formed in the capping device and is molded integrally with a cap member capable of carrying out sealing in abutment on the nozzle forming surface of the recording head. In another preferred embodiment, moreover, a concave portion constituting a box-shaped space is formed between a cap member formed in the capping device and capable of carrying out sealing in abutment on the nozzle forming surface of the recording head and the wiper cleaner provided in the capping device, and a through hole is formed in a lower bottom part of the concave portion and a discharge pipe is protruded downward to surround the through hole.

In a further preferred embodiment, moreover, the capping device is provided with a housing portion of the wiper cleaner constituting a box-shaped space portion on the print region side and a part of the wiper cleaner accommodated in the housing portion is protruded in a horizontal direction such that it can abut on the wiping device. Also in this case, it is preferable that a through hole should be formed in a lower bottom part of the housing portion and a discharge pipe should be protruded downward to surround the through hole.

The wiping device is so constituted as to advance and retreat in a horizontal direction perpendicular to the moving path for the recording head. In this case, it is desirable that the wiper cleaner should be provided in the vicinity of an advance and retreat path for the wiping device. Furthermore, it is desirable that the wiper cleaner should be provided on a frame of the sucking pump.

Moreover, a driving mechanism of the wiping device can also employ such a structure as to include a cam mechanism having a pump driving shaft for driving the sucking pump and a gear device to be driven by a rotation of the pump driving shaft. In this case, it is desirable that the driving mechanism should be constituted by a driving mechanism for applying, to the wiping device, such driving force as to advance to the moving path by a rotation in a sucking direction of the pump driving shaft and to retreat from the moving path by a rotation in an opposite direction to the sucking direction.

On the other hand, the invention provides a cleaning control method for a wiping member in an ink jet recording apparatus comprising an ink jet recording head mounted on a carriage capable of being reciprocated and serving to discharge an ink drop corresponding to print data, a capping device capable of sealing a nozzle forming surface of the recording head and sucking and discharging an ink from the recording head upon receipt of a negative pressure from a sucking pump, and a wiping device capable of cleaning the nozzle forming surface in slidable contact with the nozzle forming surface of the recording head, comprising the steps of causing the wiping device to advance to a moving path for the recording head into a wiper set state with the nozzle forming surface of the recording head sealed by the capping device, causing a wiper cleaner provided in the capping device to abut on the wiping device in the set state with the nozzle forming surface of the recording head unsealed from the capping device, causing the wiping device to slidably come in contact with the nozzle forming surface with a movement of the recording head toward a print region side, and causing the wiping device to retreat from the moving path for the recording head with the wiper cleaner abutting on the wiping device, and removing a waste ink sticking to the wiping device through the wiper cleaner.

In this case, in such a condition that the nozzle forming surface of the recording head is sealed by the capping device, a cleaning operation for applying a negative pressure into the capping device through the sucking pump to suck and discharge an ink from the recording head is carried out.

According to the ink jet recording apparatus employing the cleaning control method for the wiping member, the wiping device is constituted to advance to and retreat from the moving path for the recording head and the wiper cleaner is caused to abut on the wiping device in the set state in which the wiping device advances. When the wiping device is to brought into the reset state in which it retreats from the moving path for the recording head, the waste ink sticking to the wiping device is wiped away through the wiper cleaner and the wiping device is cleaned. At this time, the wiper cleaner is relatively moved in the plane direction of the wiping device. Therefore, the waste ink sticking to the wiping device can be prevented from being scattered.

In this case, the recording head is sealed by the capping device and the wiping device is caused to advance to the moving path for the recording head and is brought into the set state during or immediately after the execution of the cleaning operation for sucking and discharging the ink from the recording head by a negative pressure. On the other hand, the wiper cleaner is provided on the print region side in the capping device. Consequently, when the capping state of the recording head is released, the wiper cleaner can be caused to abut on the wiping device with the movement of the capping device.

By the movement of the recording head to the print region side, the nozzle forming surface can be wiped through the wiping device in the set state. Subsequently, the wiper cleaner is caused to retreat from the moving path for the recording head and is brought into the reset state so that the waste ink sticking to the wiping device can be removed by the wiper cleaner. Accordingly, the waste ink sticking to the wiping device can be cleaned away for each execution of the cleaning operation. In addition, the wiper cleaner is relatively moved in the plane direction of the wiping device. Therefore, it is possible to prevent the waste ink sticking to the wiping device from being scattered and to wipe the waste ink away.

Therefore, it is possible to effectively prevent such a problem that the thickened substance enters the fine nozzle opening on the nozzle forming surface to discharge the ink drop from the nozzle opening with difficulty when the waste ink sticking to the wiping device is thickened and the wiping operation is carried out again.

Moreover, the waste liquid ink sticking to the wiping device is wiped away by means of the wiper cleaner for each execution of the cleaning operation. Therefore, immediately after the wiping operation is ended, the degree of scatter of the waste ink into the apparatus can also be reduced by the return function of the wiping member. Furthermore, a countermeasure for collecting and dropping the waste ink wiped away by the wiper cleaner is taken as will be described below. Consequently, it is possible to effectively reduce contamination in equipment due to the waste ink and to guarantee the normal print operation of the apparatus for a long period of time.

DETAILED DESCRIPTION OF THE PREFERRED EMBODIMENTS

Figure 1:
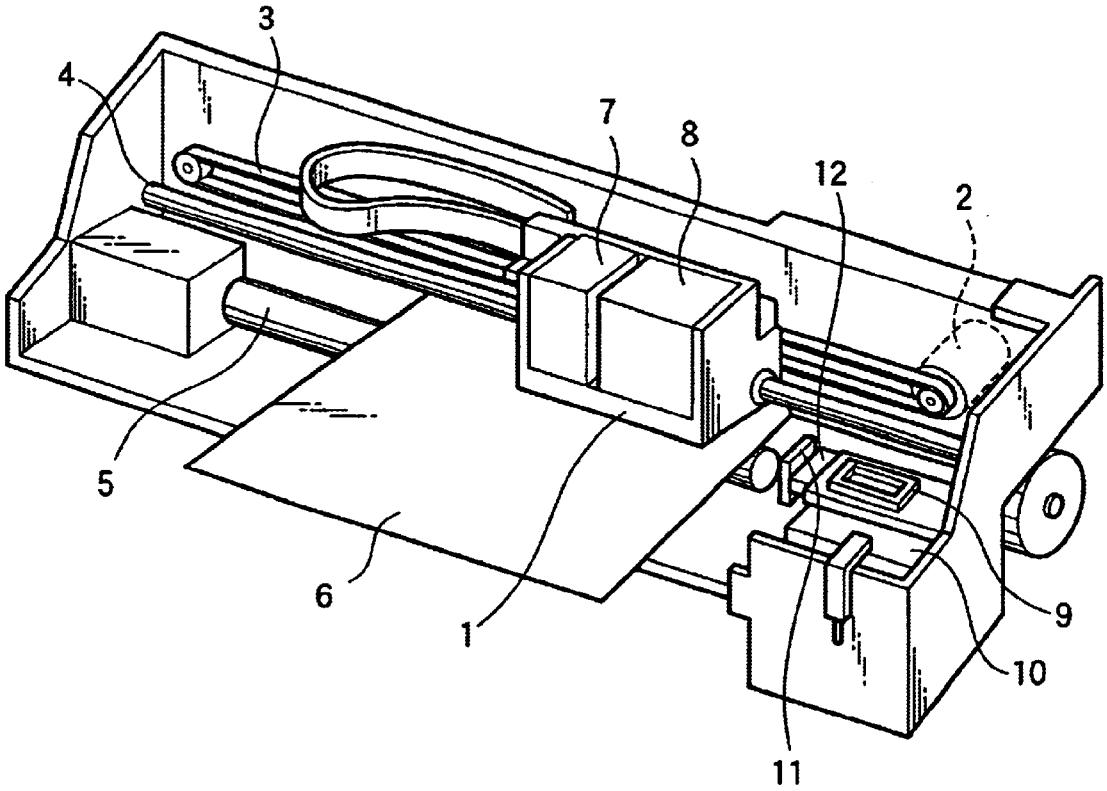
FIG. 1 is a perspective view showing the main structure of an ink jet recording apparatus to which the invention is applied.

An ink jet recording apparatus according to the invention will be described below with reference to an embodiment shown in the drawings. FIG. 1 shows the basic structure of the ink jet recording apparatus to which the invention is applied. In FIG. 1, a carriage 1 is so constituted as to be guided to a guide member 4 through a timing belt 3 driven by a carriage motor 2 and to be reciprocated in the axial direction of a platen 5.

An ink jet recording head (not shown in FIG. 1) described below is mounted on a surface (lower surface) opposed to a recording paper 6 of the carriage 1, and a black ink cartridge 7 and a color ink cartridge 8 for supplying an ink to the recording head are removably provided on the recording head.

In the drawing, the reference numeral 9 denotes a capping device provided in a non-print region (home position) which can be lifted to seal the nozzle forming surface of the recording head when the recording head mounted on the carriage 1 is moved just above. The capping device 9 functions as a cover member for preventing the nozzle opening of the recording head from being dried for the period of rest of the recording apparatus, and furthermore, functions as means for executing a cleaning operation for applying a negative pressure from a sucking pump 10 provided adjacently to the capping device 9 to the recording head, thereby sucking and discharging an ink.

Moreover, a wiper cleaner 12 is provided to be protruded in a horizontal direction on the print region side of the capping device 9. Furthermore, wiping device 11 including a wiping member formed of a rubber material like a strap, for example, as will be described below in detail is provided on the print region side adjacent to the capping device 9 such that it can advance to and retreat from a moving path for the recording head. In the embodiment, the wiping device 11 is constituted to be moved in a vertical direction.

Next, FIGS. 2 to 5 are sectional views showing first to fourth embodiments of the capping device 9, respectively. In the capping device 9 shown in each of FIGS. 2 to 5, a cap member 22 is molded in a cap holder 21 constituting an outer shell by a dichroic molding method, for example. The cap member 22 is formed of a soft material, for example, elastomer and is constituted such that it can seal, with a sealing space, the nozzle forming surface of the recording head which will be described below.

The upper end of the cap member 22 formed of a material such as elastomer as described above is protruded from an opening end face 21*a* of the cap holder 21. The sectional shape of a protrusion in the cap member 22 is constituted to have an almost triangular shape and an end face on a top thereof constitutes a seal portion 22*a* for abutting on and sealing the nozzle forming surface of the recording head. With such a structure, the degree of sealing for the nozzle forming surface of the recording head is enhanced such that the sealing state of an internal space in the capping device 9 can be maintained well.

Moreover, an ink discharge port 21*b* is formed from the inner bottom portion of the cap member 22 through the cap holder 21 and a connecting pipe 21*c* is formed integrally with the cap holder 21 in communication with the ink discharge port 21*b*. The sucking side of the sucking pump 10 is connected to the connecting pipe 21*c*, although it is not shown. Moreover, a plurality of pin members 21*d* are erected from the inner bottom portion of the cap holder 21. Each pin member 21*d* has the function of crushing and deforming an upper end thereof by thermal caulking, thereby pressing a sheet-shaped porous member which is provided in the inner bottom portion of the cap member 22 and is not shown.

Figure 2:
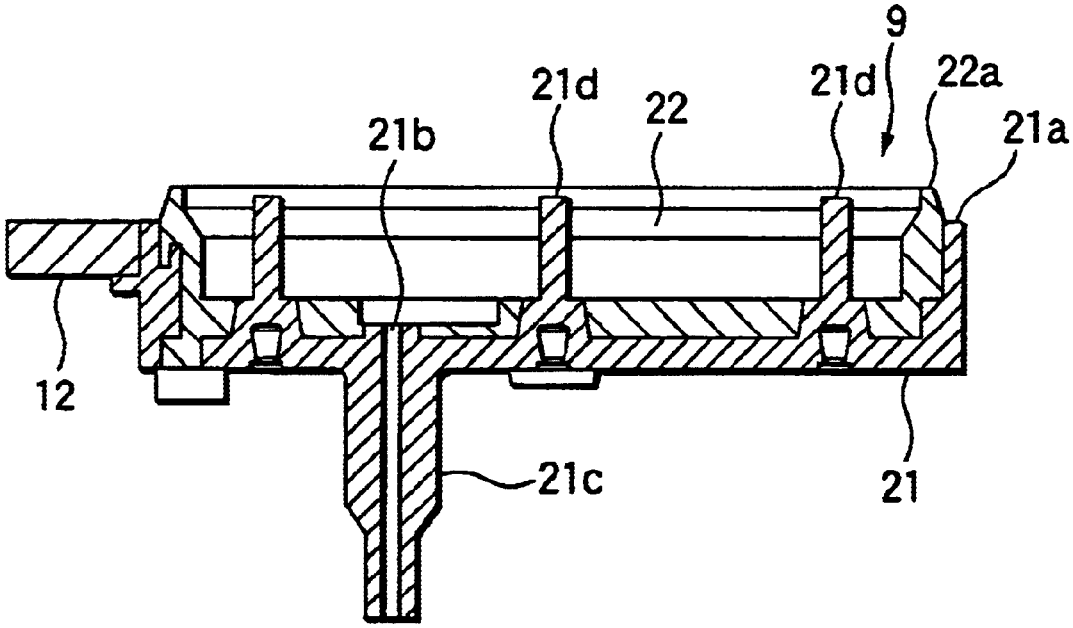
FIG. 2 is a sectional view showing a capping device in the ink jet recording apparatus according to a first embodiment of the invention.

In a first embodiment of the capping device 9 shown in FIG. 2, the wiper cleaner 12 is attached to be protruded toward the print region side. The wiper cleaner 12 is preferably constituted by an elastic material, and more preferably, a porous material capable of absorbing a waste ink, for example, urethane foam. The wiper cleaner 12 is formed with a slightly greater width than the width of the wiping device 11 as shown in FIG. 1 and is constituted such that the whole side surface of the wiping device 11 can be wiped when the wiper cleaner 12 is to abut on and to wipe the side surface of the wiping device 11 as will be described below.

Figure 3:
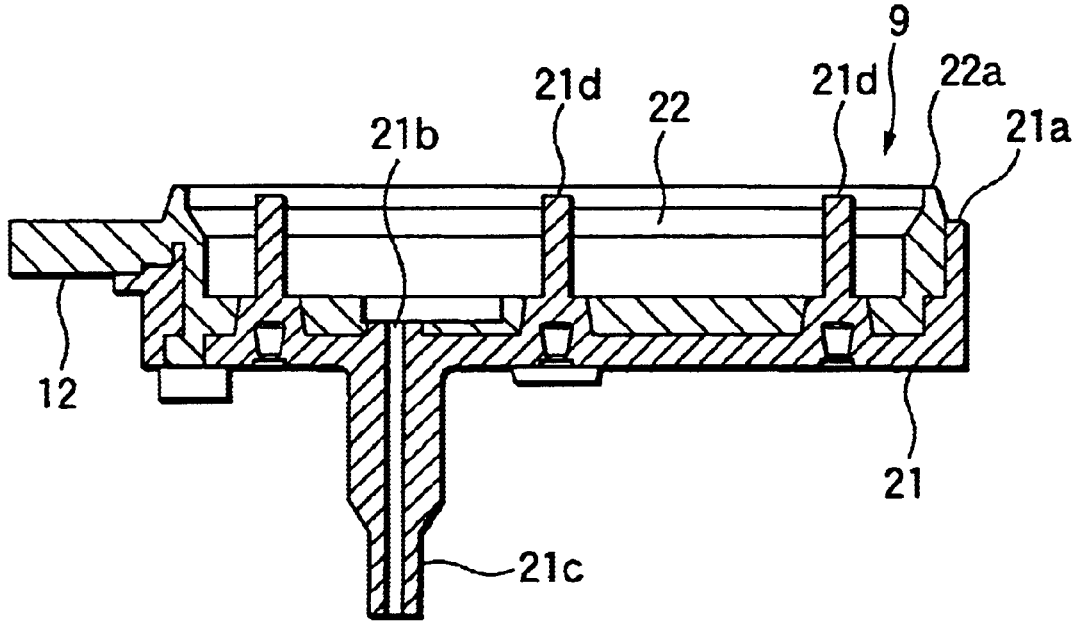
FIG. 3 is a sectional view showing a capping device in an ink jet recording apparatus according to a second embodiment of the invention.

On the other hand, in a second embodiment of the capping device 9 shown in FIG. 3, the wiper cleaner 12 is formed integrally with the cap member 22 capable of abutting on and sealing the nozzle forming surface of the recording head and is formed to be protruded toward the print region side in the same manner as in the configuration shown in FIG. 2. According to such a structure, the wiper cleaner 12 can be molded at the same time when the cap member 22 is to be molded in the cap holder 21 by a dichroic molding method. Accordingly, the wiper cleaner 12 in the second embodiment is formed of elastomer to be the same material as that of the cap member 22.

Figure 4:
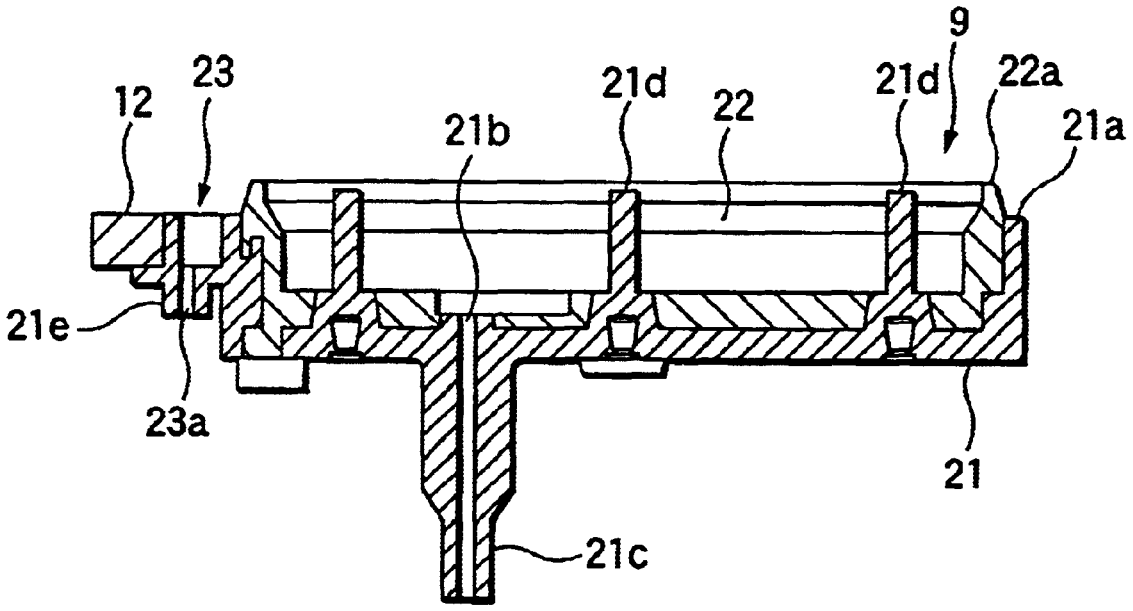
FIG. 4 is a sectional view showing a capping device in an ink jet recording apparatus according to a third embodiment of the invention.

In a third embodiment of the capping device 9 shown in FIG. 4, a concave portion 23 constituting a box-shaped space is formed in the cap holder 21 between the cap member 22 formed on the cap holder 21 and the wiper cleaner 12 attached to the print region side in the cap holder 21. The concave portion 23 is formed such that a content volume thereof has the shape of a rectangular parallelepiped and the width of the concave portion 23 in a direction perpendicular to a paper has a slightly greater width than the width in the same direction of the cap member 22 on the paper in FIG. 4.

A through hole 23*a* is formed in the lower bottom part of the concave portion 23 and a discharge pipe 21*e* is protruded downward to surround the through hole 23*a*. Also in the third embodiment, the wiper cleaner 12 is preferably constituted by an elastic material, and more preferably, a porous material capable of absorbing a waste ink, for example, urethane foam is used in the same manner as in the first embodiment shown in FIG. 2.

With such a structure, in the case in which the cap holder 21 is inclined slightly downward toward the print region side as will be described below, the waste ink overflowing from the cap member 22 can be received by the concave portion 23 and the waste ink overflowing from the cap member 22 can be prevented from reaching the wiper cleaner 12. The waste ink received by the concave portion 23 can be intensively dropped through the through hole 23*a*. By taking a countermeasure for receiving the waste ink just below, therefore, contamination in equipment due to the waste ink can be reduced effectively.

Figure 5:
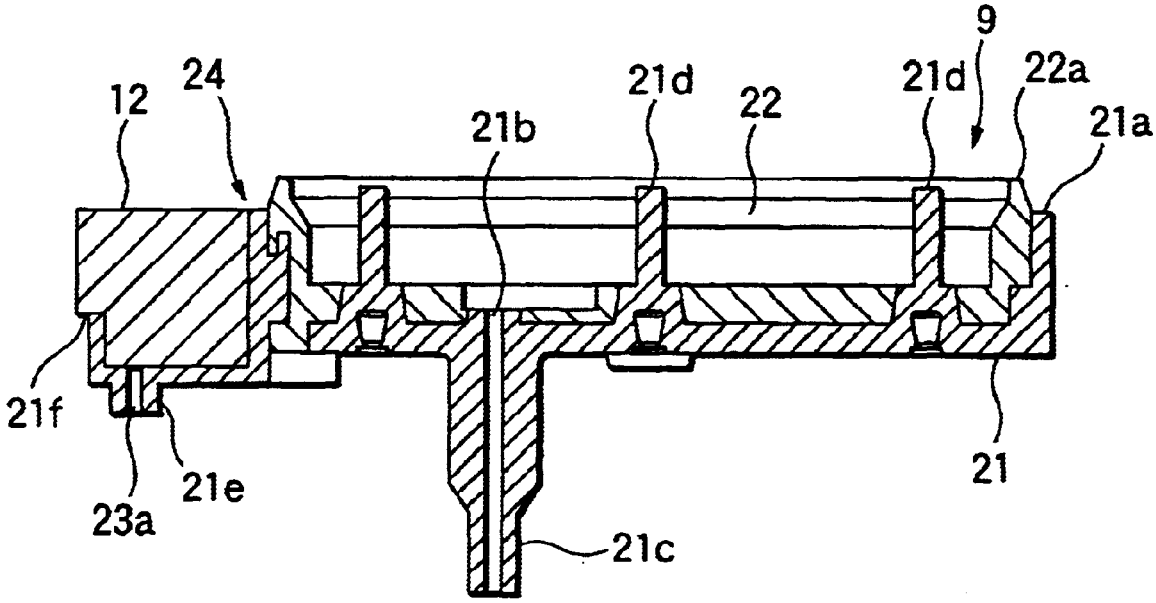
FIG. 5 is a sectional view showing a capping device in an ink jet recording apparatus according to a fourth embodiment of the invention.

In a fourth embodiment of the capping device 9 shown in FIG. 5, furthermore, a housing portion 24 of the wiper cleaner 12 constituting a box-shaped space portion is formed on the print region side of the cap holder 21. The wiper cleaner 12 is accommodated such that the whole housing portion 24 is embedded, and a nick portion 21*f* is formed on the print region side of the housing portion 24 so that a window hole is formed. Consequently, a part of the wiper cleaner 12 can be protruded in a horizontal direction to abut on the side wall of the wiping device 11.

Also in the fourth embodiment, a through hole 23*a* is formed in the lower bottom part of the housing portion 24 constituting the box-shaped space portion, and a discharge pipe 21*e* is protruded downward to surround the through hole 23*a*. Also in the fourth embodiment, moreover, the wiper cleaner 12 is constituted by an elastic material, and more preferably, a porous material capable of absorbing a waste ink, for example, urethane foam.

According to such a structure, in the case in which the cap holder 21 is inclined slightly downward toward the print region side, the waste ink overflowing from the cap member 22 can be received and absorbed by the wiper cleaner 12. As will be described below, moreover, the waste ink removed from the wiping device 11 in slidable contact with the wiping device 11 can also be absorbed by the wiper cleaner 12. The waste ink absorbed by the wiper cleaner 12 is transmitted over the wiper cleaner 12 and is moved to the lower bottom portion side of the housing portion 24, and can be intensively dropped through the through hole 23*a*. By taking a countermeasure for receiving the waste ink just below, accordingly, contamination in equipment due to the waste ink can be reduced effectively.

According to the structure of the capping device shown in FIG. 5, moreover, it is possible to obtain an ink drop capturing function for a flushing operation which applies, to the recording head, a driving signal unrelated to printing and idly discharges an ink drop. More specifically, the ink drop is sequentially discharged idly through the nozzle opening of the recording head positioned just above the wiper cleaner 12 with the movement of the recording head so that the ink drop discharged from the nozzle opening is reliably captured and absorbed by the wiper cleaner 12 formed of urethane foam, for example. Thus, in the case in which the recording head 15 is moved to idly discharge the ink drop to the wiper cleaner 12 through flushing, a throughput can be enhanced.

Figure 6:
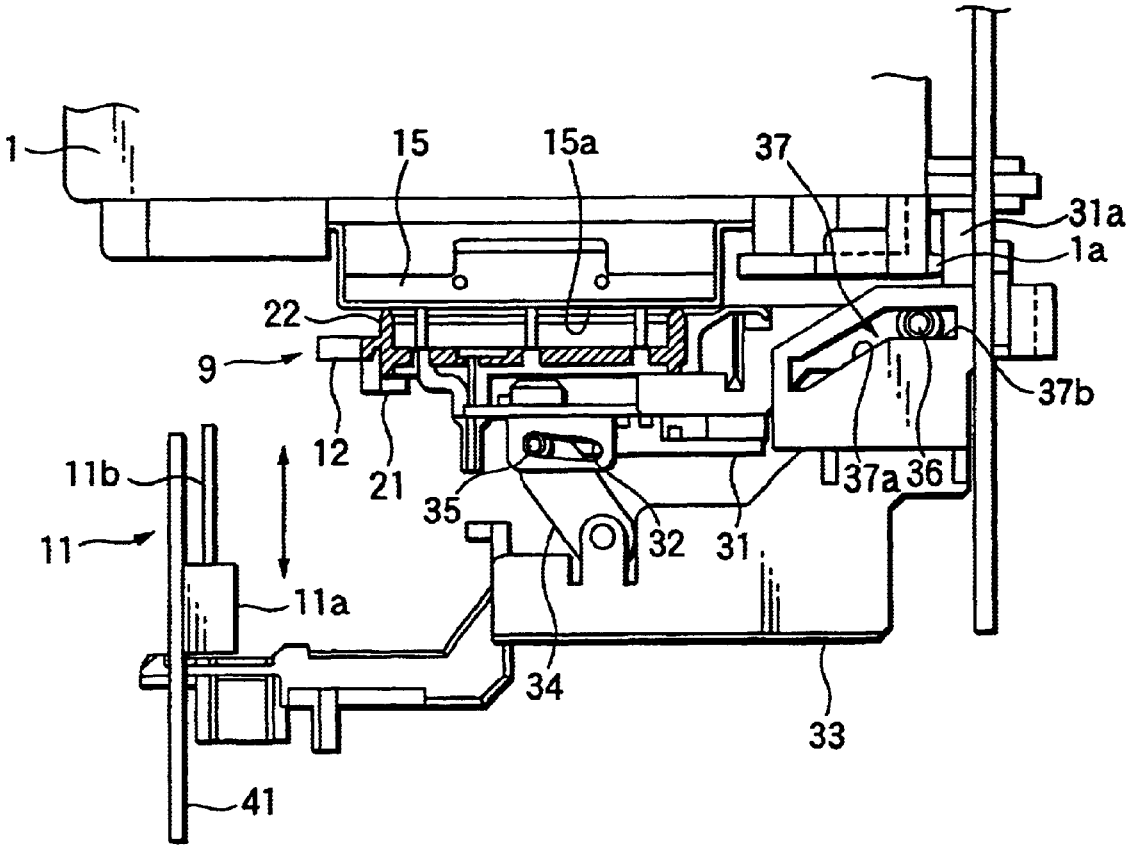
FIG. 6 is a partial sectional view showing a state in which a recording head is capped through the capping device.
Figure 7:
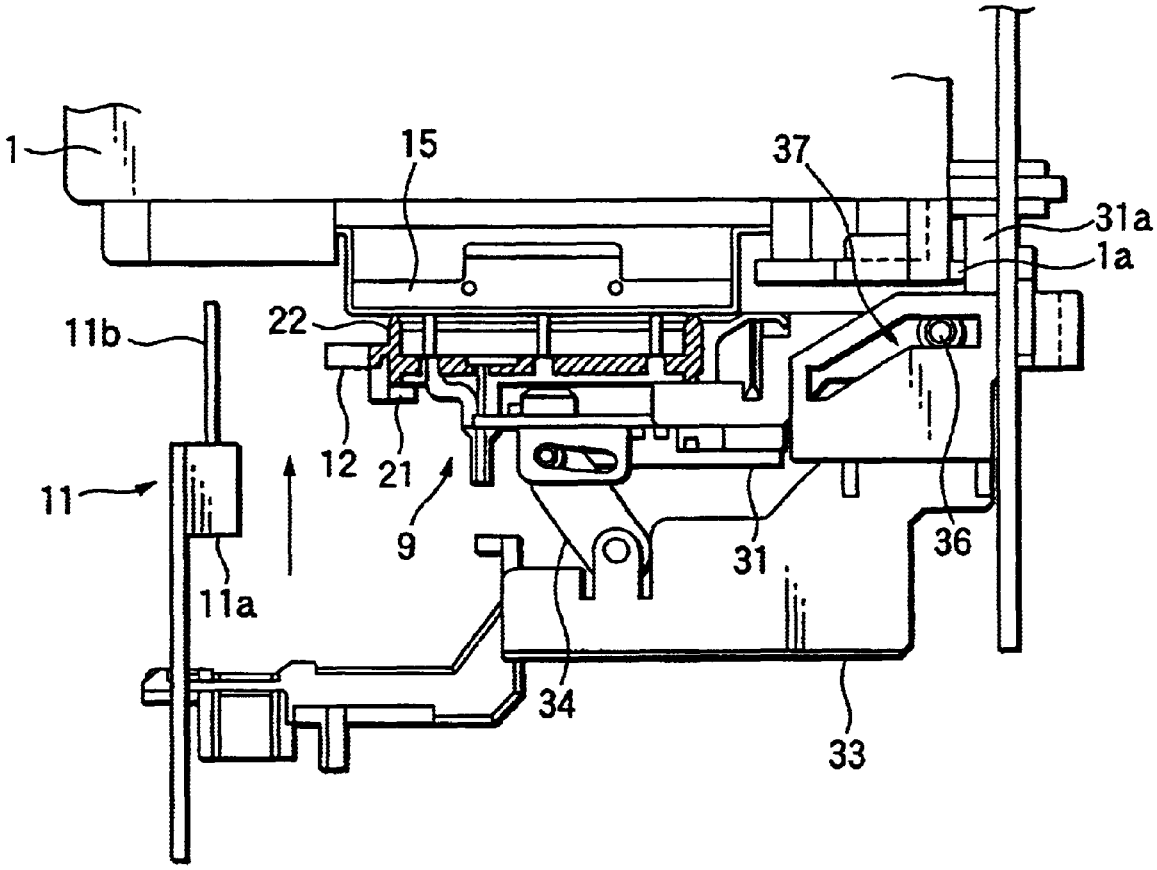
FIG. 7 is a partial sectional view showing a state in which a negative pressure is applied to the capping device and a wiping member is raised and set.
Figure 8:
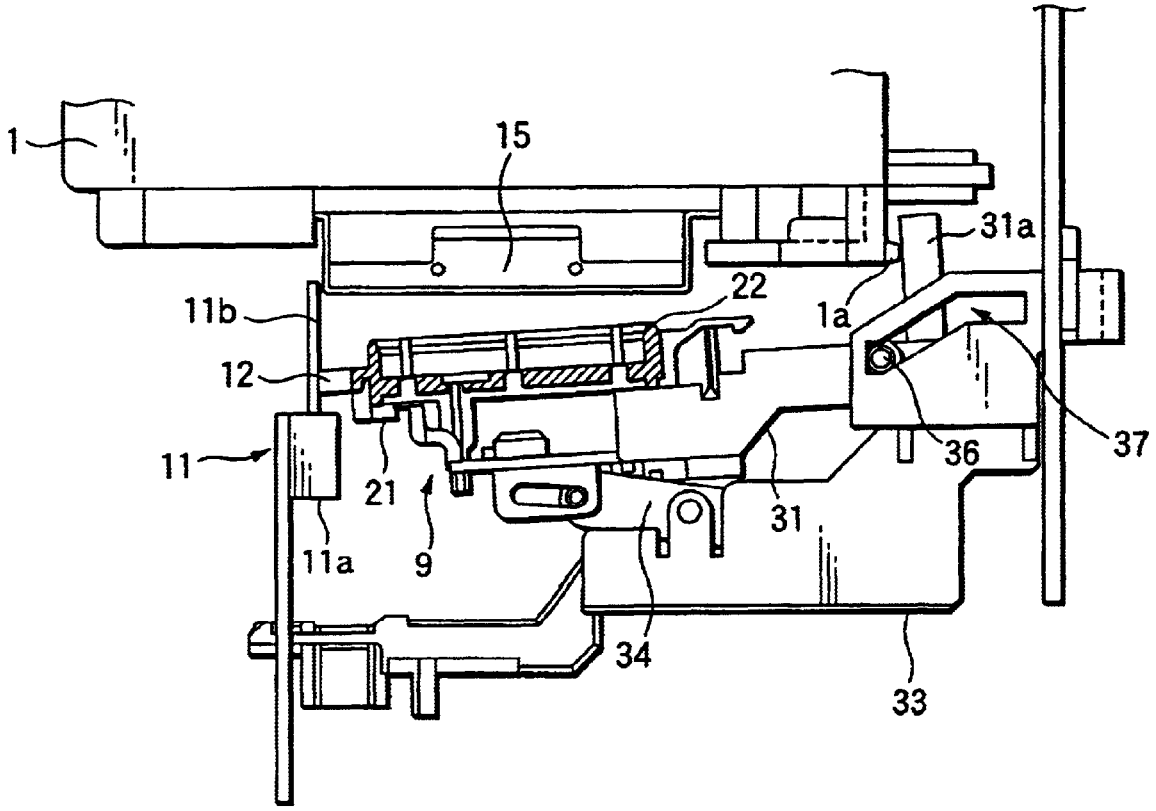
FIG. 8 is a partial sectional view showing a state in which the capping state is released.
Figure 9:
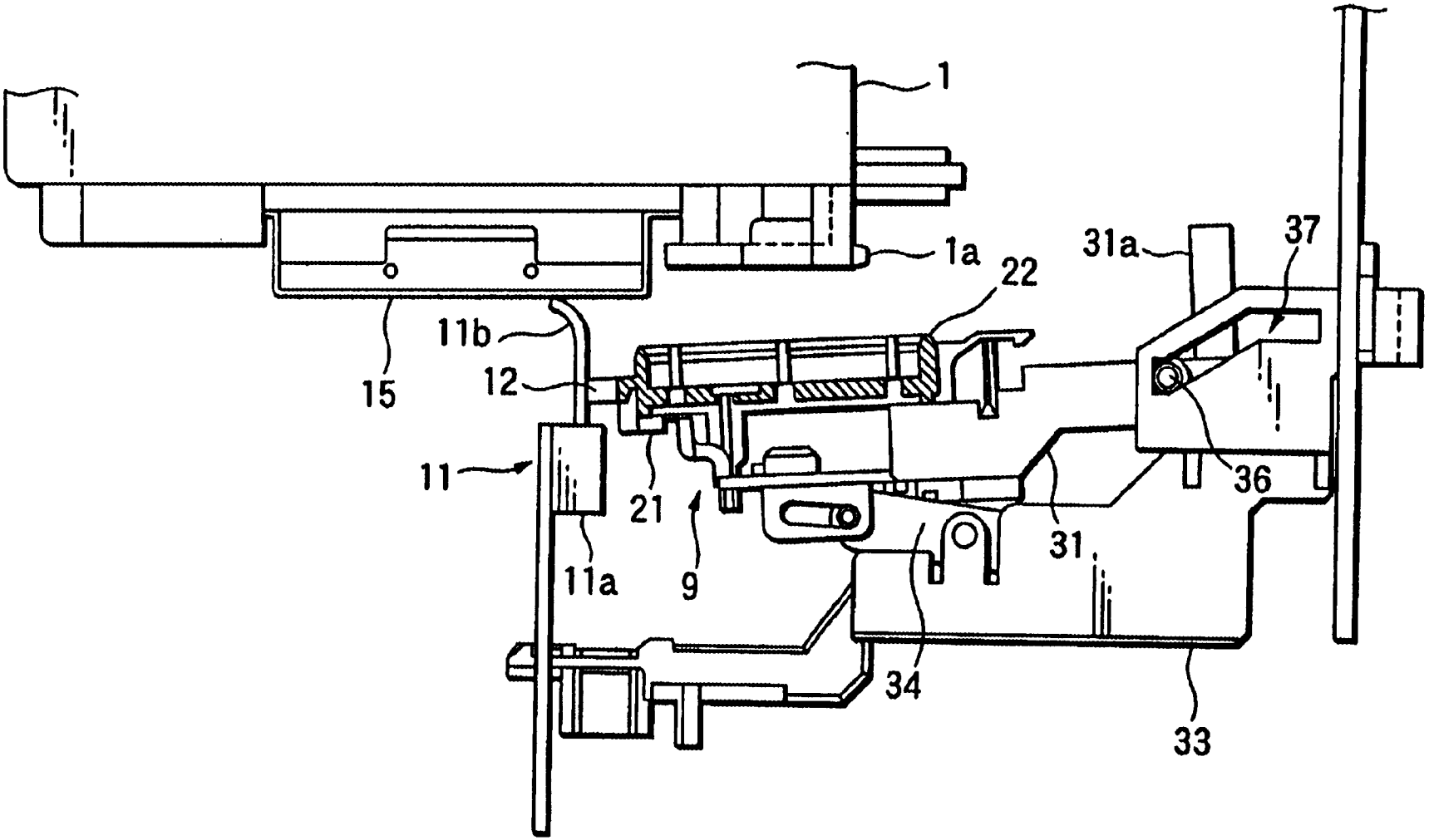
FIG. 9 is a partial sectional view showing a state in which a wiping operation is carried out.
Figure 10:
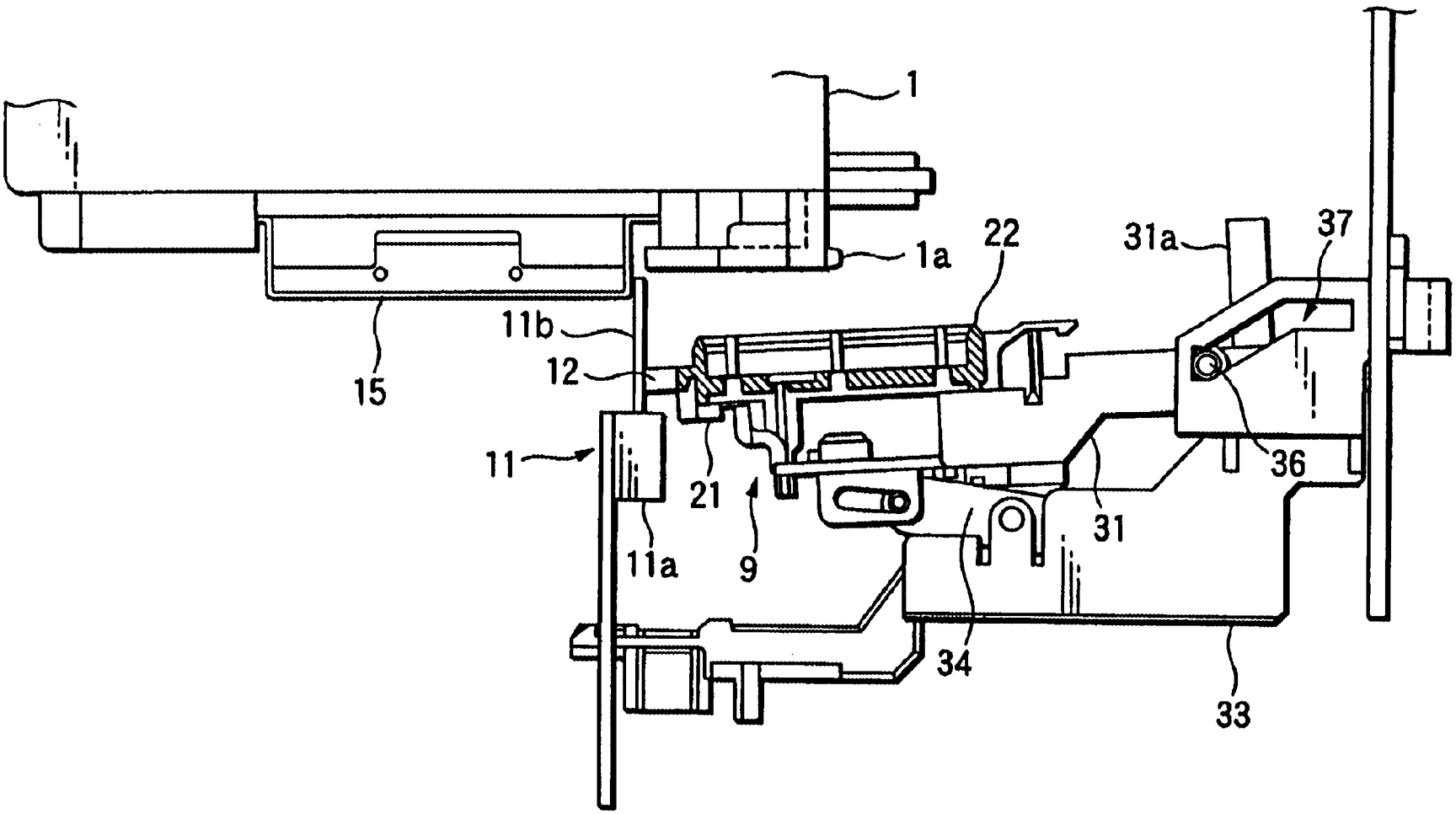
FIG. 10 is a partial sectional view showing a state in which the wiping operation is ended.
Figure 11:
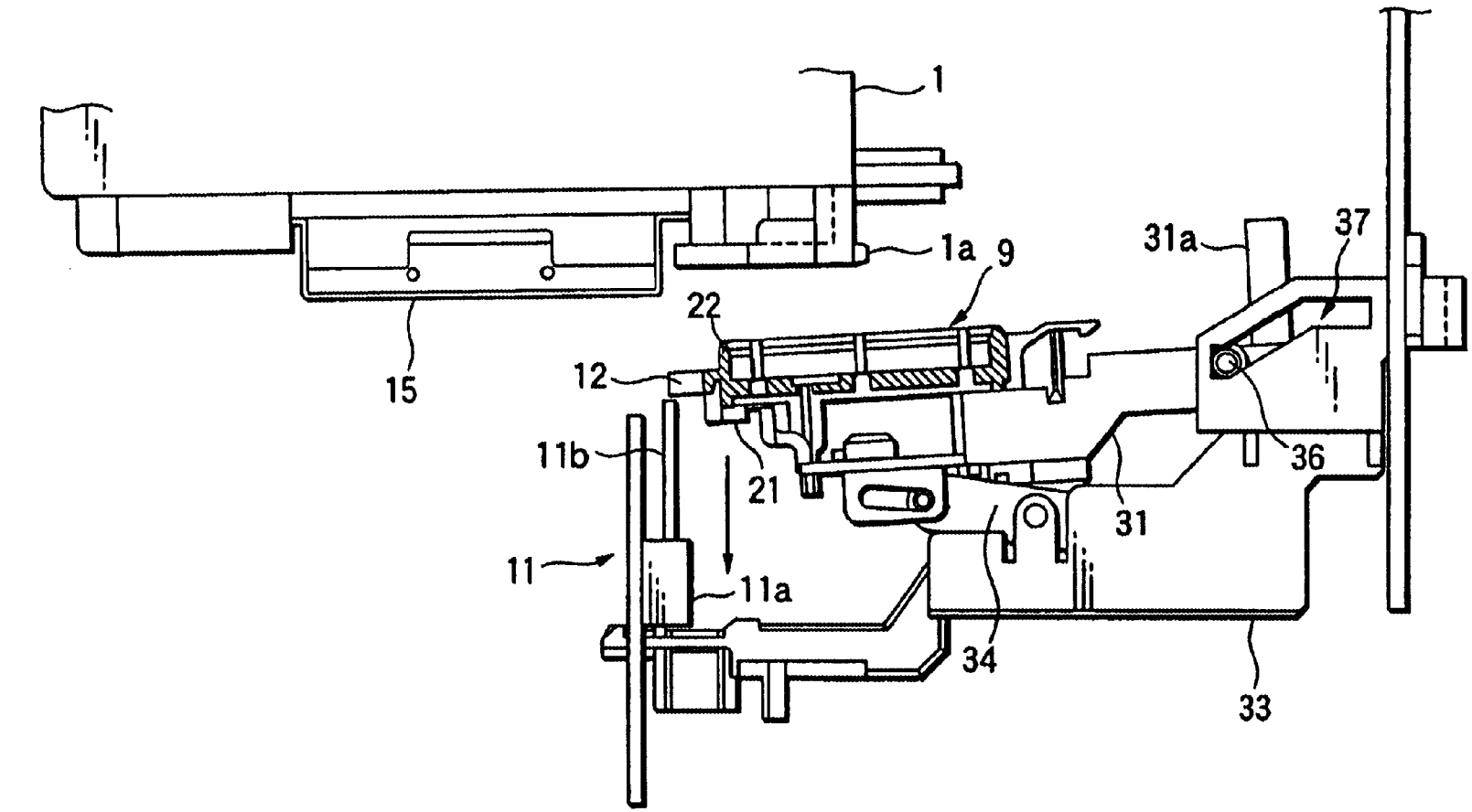
FIG. 11 is a partial sectional view showing a state in which the wiping member is dropped and reset.

FIGS. 6 to 11 show the operation of an elevating unit having the capping device 9 mounted thereon and serving to elevate the capping device 9 with the movement of a carriage and the operation of the wiping device. FIG. 6 shows a capping state and FIG. 7 shows a state in which a negative pressure is applied to the capping device 9 in the capping state and the wiping member is lifted and set at the same time. Moreover, FIG. 8 shows a state in which the capping state is released and FIG. 9 shows a state in which the wiping operation is subsequently carried out. Furthermore, FIG. 10 shows a state in which the wiping operation is ended and FIG. 11 shows a state in which the wiping member is brought down and reset.

The reference numeral of each portion corresponding to each structure in FIGS. 6 to 11 described below is mainly shown in FIG. 6 and typical other portions are indicated as the same reference numerals respectively. Moreover, FIGS. 6 to 11 show the case in which the first embodiment shown in FIG. 2 is employed as the capping device 9.

In FIGS. 6 to 11, the reference numeral 15 denotes a recording head mounted on the lower side surface of the carriage 1. The recording head 15 is moved in a transverse direction in the drawing with the movement of the carriage 1. On the other hand, the cap holder 21 is mounted on a slider 31 and is attached in a state of energization toward the recording head 15 side by means of a compression spring which is provided between the slider 31 and the cap holder 21 and is not shown.

A pair of slots 32 are formed in an almost horizontal direction in the lower bottom portion of the slider 31. A horizontal shaft 35 provided on the free end side of an arm 34 rotatably attached to a frame 33 is accommodated in each slot 32 to be movable. Consequently, the slider 31 can be erected with an almost arcuate track with respect to the frame 33 through the arm 34.

Moreover, a guide projection 36 is formed to be protruded in a horizontal direction on both sides of the end on the non-print region side (the right side in the drawing) of the slider 31 and a pair of guide projections 36 are supported on a pair of guide grooves 37 formed in the frame 33. The guide groove 37 is constituted by an inclined portion 37*a* and a horizontal high portion 37*b* which communicate with each other.

One of the ends of a tension spring having the other end fixed to the frame 33 is fastened to the slider 31, which is not shown. The slider 31 is dragged toward the print region side (the left side in the drawing) by the action of the tension spring. Consequently, the slider 31 is energized in such a direction as to separate from the nozzle forming surface of the recording head 15, that is, in such a direction as to be moved obliquely downward in the embodiment.

In the case in which the carriage 1 is moved to the right end side as shown in FIG. 6, an engaging body 1*a* provided in the carriage 1 abuts on an engaged body 31*a* formed to be erected in the slider 31. Consequently, the slider 31 is erected through the arm 34. Moreover, the guide projection 36 formed in the slider 31 is moved upward in the guide groove 37 formed in the frame 33 along the inclined portion 37*a* to the horizontal high portion 37*b*. By such a reciprocating operation, the cap member 22 formed on the cap holder 21 seals the nozzle forming surface 15*a* of the recording head 15 provided in the carriage Moreover, in the case in which the carriage 1 is moved toward the print region side as shown in FIG. 8, for example, the abutment of the engaging body la on the carriage 1 side on the engaged body 31*a* provided in the slider 31 is released so that the slider 31 is subjected to a return moving operation by the tensile force of the spring. As shown in FIG. 8, consequently, the sealing state of the nozzle forming surface of the recording head 15 through the cap member 22 is released.

As shown in FIG. 8, in such a condition that the sealing state of the nozzle forming surface of the recording head 15 through the cap member 22 is released, a seal surface in the cap member 22, that is, an upper end face abutting on the nozzle forming surface of the recording head 15 is constituted in a non-parallel state with respect to the nozzle forming surface of the recording head 15. More specifically, the seal surface of the cap member 22 is set in an inclination state such that the print region side is slightly brought downward with respect to the home position side. This is constituted by the relationship between the position of the horizontal shaft 35 accommodated in the slot 32 formed in the slider 31 and the position of arrangement of the guide projection 36 sliding in the guide groove 37 formed on the frame 33.

The cap member 22 first abuts on the nozzle forming surface on the home position side in such a state as to seal the nozzle forming surface of the recording head 15, and functions to seal the whole nozzle forming surface 15*a* of the recording head 15 by the contracting action of a compression spring according to a rise in the slider 31 which is provided between the slider 31 and the cap holder 21 and is not shown. Moreover, in the case in which the cap member 22 is to release the sealing state of the nozzle forming surface of the recording head 15, it functions to first separate from an end on the print region side with respect to the nozzle forming surface of the recording head 15 and to separate in a non-parallel state with respect to the nozzle forming surface with a greater distance on the print region side of the cap member.

Thus, when releasing the sealing state of the nozzle forming surface of the recording head, the cap member 22 functions to separate from an end on the print region side in a non-parallel state with respect to the nozzle forming surface of the recording head 15. Therefore, a waste ink to remain in the nozzle forming surface of the recording head 15 is subjected to the function of return to the side of the waste ink stored in the cap member 22. By such a function, the amount of the ink remaining in the nozzle forming surface of the recording head 15 can be reduced as much as possible. Moreover, the release of the sealing state of the cap member 22 with respect to the nozzle forming surface of the recording head 15 proceeds from one of the ends. Consequently, it is also possible to reduce such a phenomenon that the waste ink stored in the cap member 22 is unnecessarily bubbled.

On the other hand, the wiping device 11 is provided on the print region side of the capping device adjacent to the capping device 9. The wiping device 11 is constituted by a wiper holding member 11*a* attached to be slidable in a vertical direction in the drawing with respect to a frame substrate 41 and a wiping member 11*b* attached to the upper surface of the wiper holding member 11*a* in an erection state and formed of a rubber material like a strap, for example. Accordingly, the wiper holding member 11*a* is moved in the vertical direction by means of an actuator which is not shown so that the tip portion of the wiping member 11*b* is selectively brought into a set state in which it advances to the moving path for the recording head and a reset state in which it retreats from the moving path for the recording head.

Figure 12:
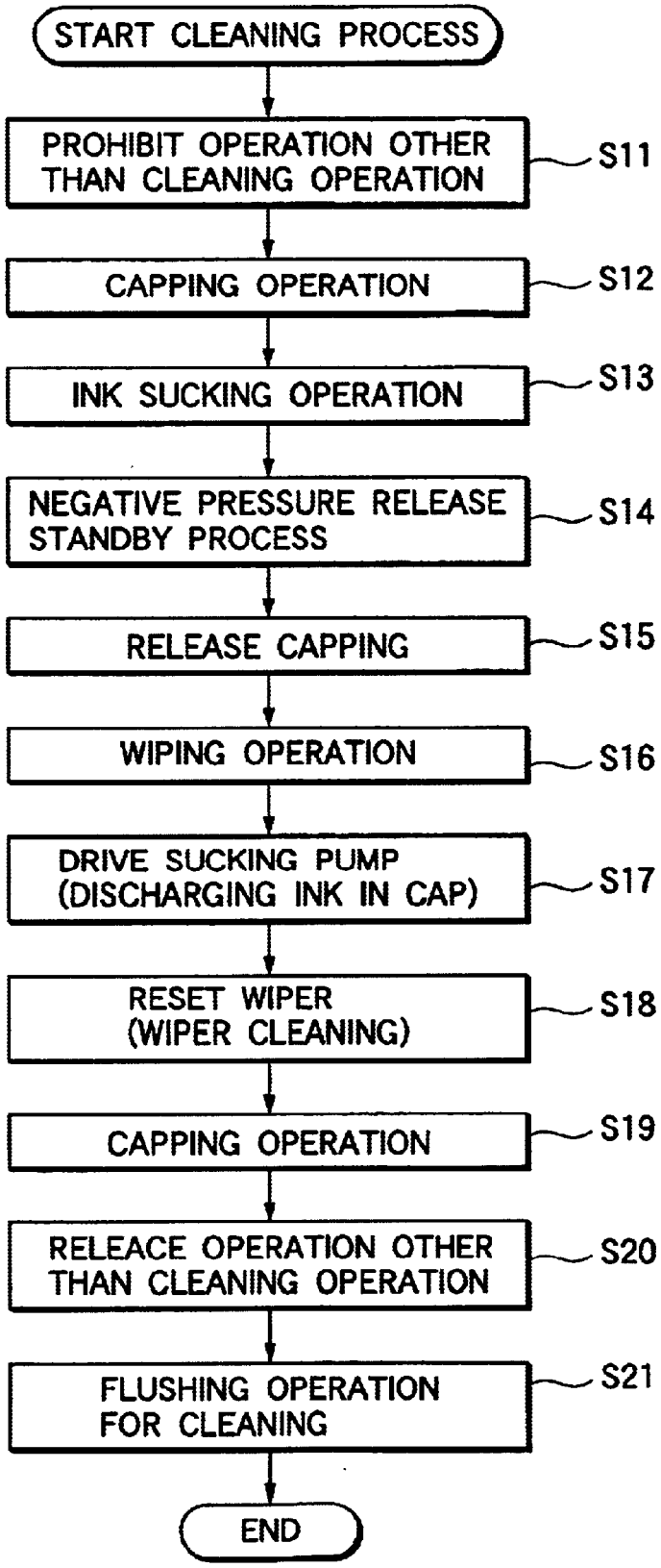
FIG. 12 is a flow chart for explaining a cleaning control method for wiping device with a cleaning operation.

FIG. 12 shows a sequence for explaining the cleaning control method for the wiping device which is carried out by the recording apparatus having the structure described above. Corresponding to each of FIGS. 6 to 11, the wiping operation of the wiping device and the operation for removing a waste ink sticking to the wiping device will be described. First of all, when a cleaning process is started, all unnecessary operations for the cleaning process such as a paper feeding operation are prohibited as shown in Step S11. Then, a capping operation is carried out as shown in Step S12. More specifically, the carriage 1 is moved to the capping position as shown in FIG. 6.

As shown in Step S13, subsequently, an ink sucking operation and a wiper set operation are carried out. Such a state is shown in FIG. 7, and the sucking pump 10 is driven in the capping state. Consequently, a negative pressure is applied into the capping device 9 and the ink is sucked and discharged from the recording head. In a state in which the ink is sucked and discharged from the recording head or immediately thereafter, the wiper holding member 11*a* is moved upward as shown in FIG. 7 so that the tip portion of the wiping member 11*b* attached to the holding member 11*a* advances to the moving path for the recording head and is brought into the set state.

As shown in Step S14, the step of a negative pressure release stand by process is executed. In this step, a state in which the nozzle forming surface of the recording head 15 is sealed by the cap member 22 is held and a standby is carried out until a predetermined time required for causing the internal space of the cap member 22 to have an atmospheric pressure again passes. The ink is discharged in a predetermined amount through the recording head in the standby step and the negative pressure in the internal space of the cap member 22 is almost equal to the atmospheric pressure.

Thus, when a pressure in the cap member 22 almost reaches the atmospheric pressure, the capping release step of releasing the sealing state of the nozzle forming surface of the recording head through the cap member 22 is executed as shown in Step S15. The capping release is executed by movement of the carriage 1 toward the print region side as shown in FIG. 8. At this time, the tip portion of the wiper cleaner 12 provided in the cap holder 21 abuts on the side wall of the wiping member 11*b* in the set state.

By further moving the carriage 1 toward the print region side, then, a wiping operation (Step S16) in which the wiping member 11*b* provided in the erection state as shown in FIG. 9 slidably comes in contact with the nozzle forming surface is executed so that the nozzle forming surface is cleaned. When the wiping member 11*b* is relatively positioned on the terminal end of the nozzle forming surface, the movement of the carriage 1 is stopped. FIG. 10 shows such a state. In this state, the process proceeds to Step S17 where the sucking pump 10 is temporarily driven. The sucking pump 10 is driven, thereby executing the operation for discharging the ink from the cap member 22.

Subsequently, a wiper reset operation is executed as shown in Step S18. FIG. 11 shows such a state and the wiping member 11*b* mounted on the wiper holding member 11*a* is moved downward in the drawing. Consequently, the waste ink sticking to the wiping member 11*b* is removed by the wiper cleaner 12 slidably coming in contact with a side wall thereof. In other words, the wiper cleaner 12 removes the waste ink sticking to the wiping device 11 with the advance and retreat operations of the wiping device 11.

In this case, as shown in the wiping state of FIG. 9, most of the waste ink scraped off from the recording head by the wiping operation sticks to the surface of the wiping member 11*b* which is opposed to the wiper cleaner 12 and almost all the waste inks are removed by the wiper cleaner 12 with the wiper reset operation.

In addition, since the wiper cleaner 12 is moved in the plane direction of the wiping member 11*b,* the waste ink sticking to the wiping device 11 can be removed while suppressing the scatter.

In the wiper reset state shown in FIG. 11, the carriage 1 is moved to the home position side and is brought into the capping state again as shown in FIG. 6 (Step S19). Subsequently, operations other than the cleaning process which have been prohibited can be executed as shown in Step S20, and the standby state is brought in such a condition that a flushing operation for cleaning is executed as shown in Step S21. Thus, the cleaning operation is ended.

In the structures shown in FIGS. 6 to 11, the capping device 9 according to the first embodiment shown in FIG. 2 is employed and the respective capping device according to the second to fourth embodiments shown in FIGS. 3 to 5 can be utilized. In this case, the features of the respective capping device can be used practically.

Figure 13A:
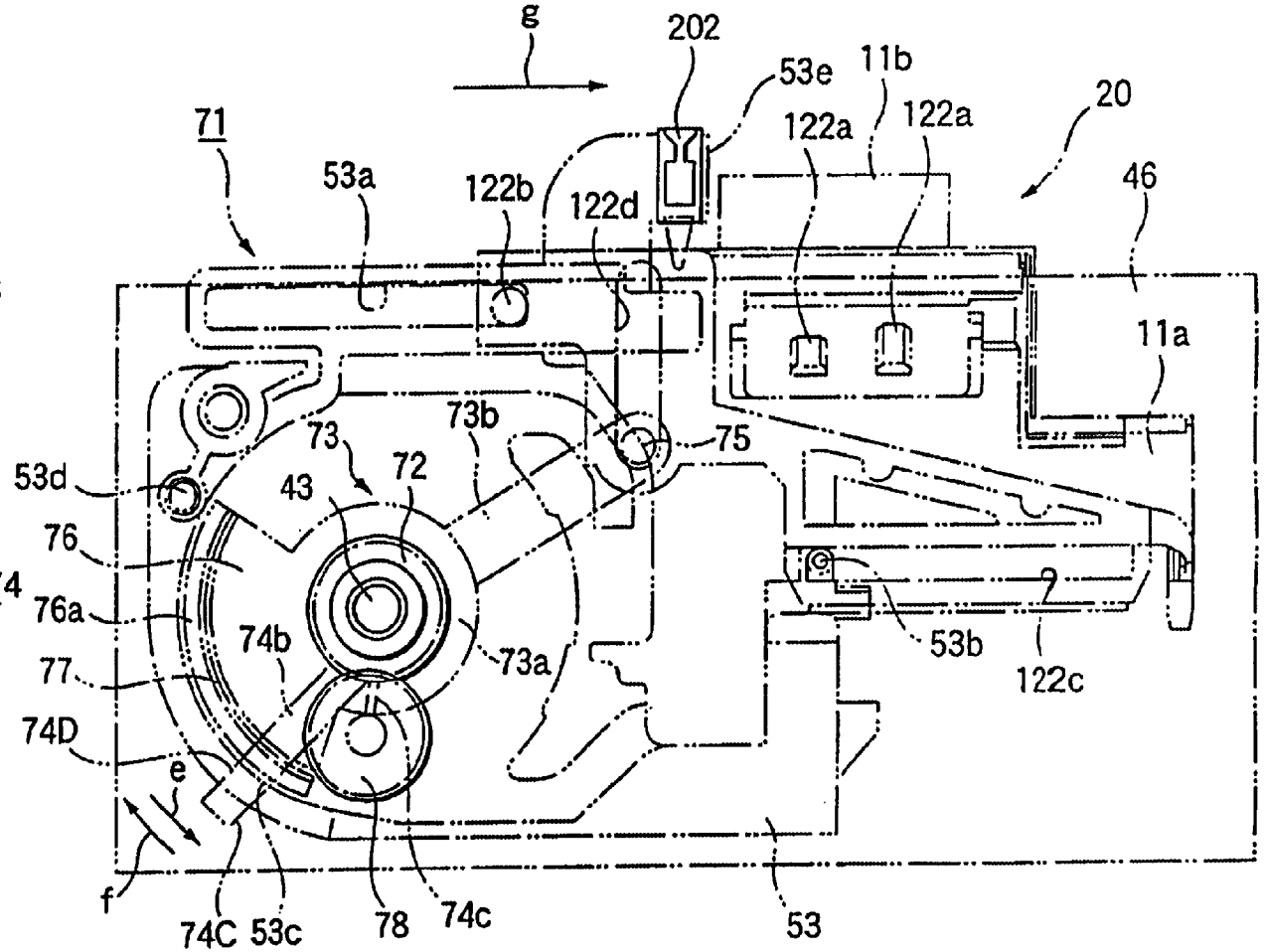
FIGS. 13A and 13B are perspective views showing a wiper set state in which a wiping device in an ink jet recording apparatus according to a fifth embodiment of the invention is caused to advance to a moving path for a recording head.
Figure 13B:
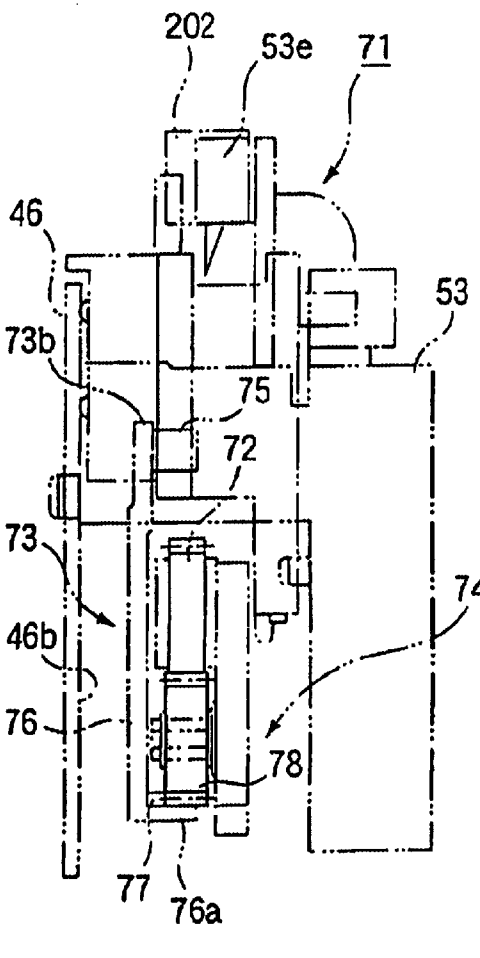
Figure 14:
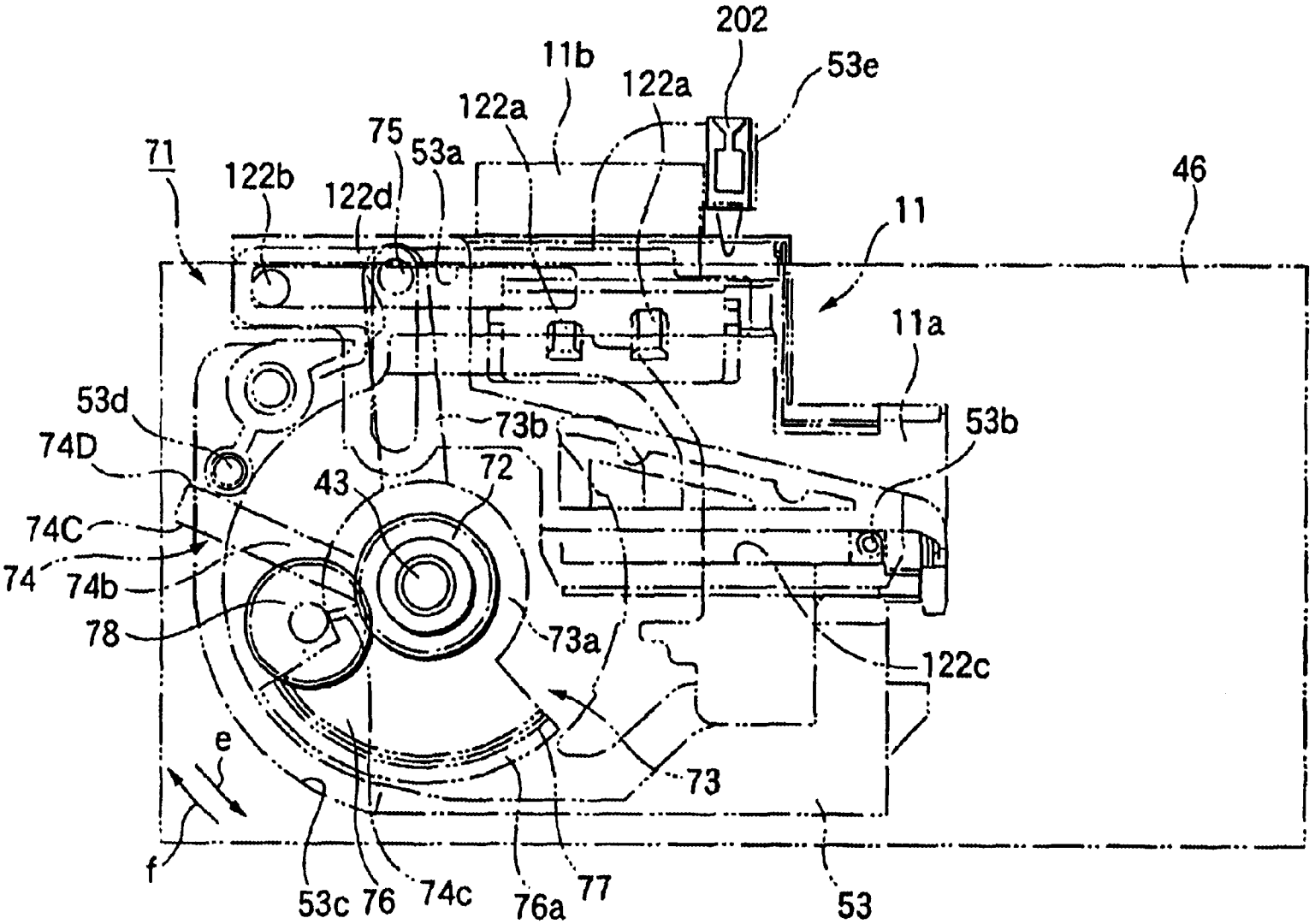
FIG. 14 is a perspective view showing a wiper reset state in which the wiping device in the ink jet recording apparatus according to the fifth embodiment of the invention is caused to retreat from the moving path.

While the case in which the wiper cleaner 12 is provided in the capping device 9 to be an operating member has been described in each of the embodiments (the first to fourth embodiments), the invention is not restricted thereto but the same effects as those in the embodiments can be obtained even if the wiper cleaner 12 is provided in a pump frame to be a fixing member as shown in FIGS. 13A, 13B and 14.

FIGS. 13A and 13B are perspective views showing a wiper set state in which wiping device in an ink jet recording apparatus according to a fifth embodiment of the invention is caused to advance to a moving path for a recording head. FIG. 14 is a perspective view showing a wiper reset state in which the wiping device in the ink jet recording apparatus according to the fifth embodiment of the invention is caused to retreat from the moving path. In these drawings, the same members as those in FIGS. 1 to 11 have the same reference numerals and detailed description will be omitted. The driving force of a paper feeding motor for delivering the recording paper 6 is utilized for the moving operation of the wiping device 11 and the sucking operation of the sucking pump 10 for causing the internal space of the capping device 9 to have a negative pressure.

The wiping device 11 is so constituted as to advance and retreat in a horizontal direction perpendicular to the direction of reciprocation of the carriage 1 inside and outside the moving path for the recording head 15 with the driving operation of the sucking pump 10. Moreover, the sucking pump (tube pump) 10 is attached to an attachment base (which will be described below) to be a fixing member.

A driving mechanism 71 for wiping device is provided between a pump frame 53 of the sucking pump 10 and an attachment base 46 (metal plate) of the pump frame 53. The driving mechanism 71 includes a pump driving shaft (pump shaft) 43 having a sun gear 72, and a cleaner driving lever 73 and a gear holding lever 74 which are provided longitudinally in the moving direction of the head of the driving shaft 43.

The non-print region side portion (pump side portion) of the attachment base 46 is provided with a guide face 46*b* for guiding the wiping device 11 in advance and retreat directions. The wiping device 11 can stably carry out the advance and retreat operations.

Figure 15A:
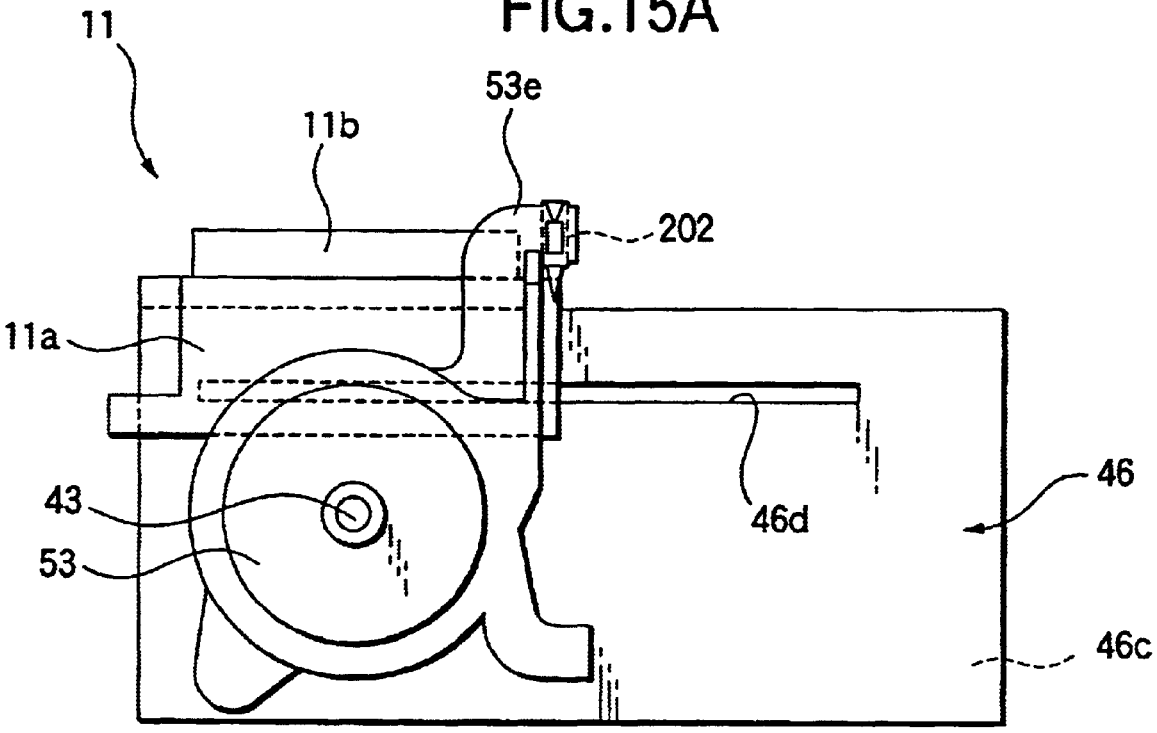
FIGS. 15A and 15B are front and side views showing a state in which a wiper cleaner is attached in the ink jet recording apparatus according to the fifth embodiment (variant) of the invention.
Figure 15B:
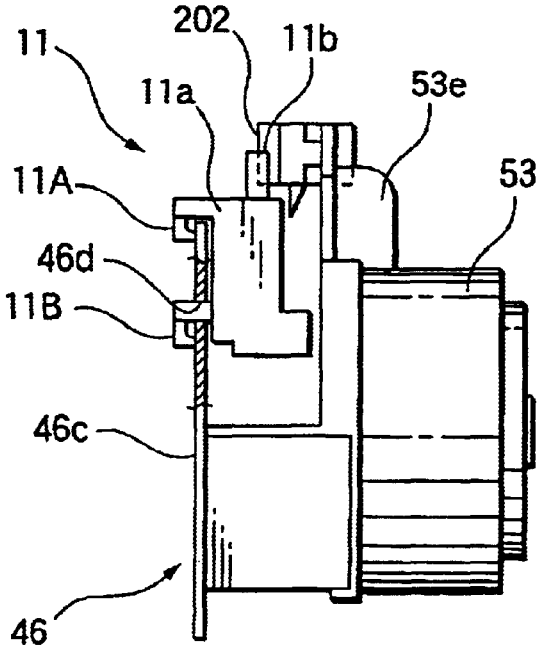

As shown in FIGS. 15A and 15B, the print region side portion of the attachment base 46 may be provided with a guide face 46*c* and a slot 46*d* for wiper sliding which is extended in the advance and retreat directions of the wiping device 11 such that the stable advance and retreat operations of the wiping device 11 may be carried out. In this case, hook-shaped click portions 11A and 11B for preventing slip-off which can slide over the guide face 46*c* are provided in the wiper holding member 11*a* of the wiping device 11 vertically in parallel.

Moreover, a wiper cleaner 202 facing an advance and retreat path for the wiping device 11 is provided through a rising portion 53*e* on the head moving path side of the pump frame 53. The wiper cleaner 202 is so constituted as to be elastically deformed due to a sliding contact with the wiping member 11*b* during the advance and retreat of the wiping device 11, thereby cleaning an ink wiping portion thereof (the non-print region side portion of the wiping member 11*b*).

The cleaner driving lever 73 has an annular base portion 73*a* for inserting the driving shaft 43 there through, and a tongue-shaped lever portion 73*b* protruded from the base portion 73*a,* and is provided on the opposite pump side of the gear holding lever 74 and is rotatably supported pivotally on the driving shaft 43 in a predetermined rotation stroke (within a range to satisfy $\theta \leqq 66$ degrees, wherein the rotation stroke is represented by a rotation angle $\theta$). A cylindrical driving pin 75 protruded toward the pump side (in a horizontal direction) is provided integrally with the lever portion 73*b* of the cleaner driving lever 73. Moreover, the base portion 73*a* of the cleaner driving lever 73 is integrally provided with a planar fan-shaped extended portion 76 protruded toward the opposite side of the lever portion 73*b* and having a rising wall 76*a* on an outer peripheral edge. A circumferential inside gear 77 is provided on the rising wall 76*a* of the extended portion 76.

A triangular pole-shaped click portion 122*a* for attaching the wiping member 11*b* thereto and a cylindrical slide pin 122*b* protruded toward the pump side are provided on the upper end of the wiper holding member 11*a* in the wiping device 11. The lower end of the wiper holding member 11*a* is provided with a concave groove 122*c* extended in a direction (a lateral direction) perpendicular to the moving path for the recording head 15. Moreover, the wiper holding member 11*a* is provided with a concave groove 122*d* extended in a vertical direction and serving to guide the driving pin 75.

The upper end of the pump frame 53 is provided with a concave groove 53*a* extended in the lateral direction (a direction perpendicular to the moving path for the recording head 15 and the direction of extension of the concave groove 122*d*) and serving to guide the slide pin 122*b*. A cylindrical fixing pin 53*b* protruded toward the wiping device side and facing the inside of the concave groove 122*c* is provided on the head moving path side of the pump frame 53. Moreover, the lower end of the pump frame 53 is provided with two stoppers 53*c* and 53*d* in parallel corresponding to the two rotation stop positions of the gear holding lever 74 to be described below with a predetermined space formed in a circumferential direction.

On the other hand, the gear holding lever 74 has an annular base portion (not shown) for inserting the driving shaft 43 therethrough and rectangular tongue-shaped lever portions 74*b* and 74*c* protruded in the radial direction of the base portion, and is rotatably supported pivotally on the driving shaft 43 between two rotation stop positions. The lever portion 74*b* of the gear holding lever 74 is provided with stopper engagement portions 74C and 74D capable of being engaged with the stoppers 53*c* and 53*d*. Moreover, a planetary gear 78 capable of being mated with the inside gear 77 of the cleaner driving lever 73 is mated with the sun gear 72 and is rotatably held in the lever portion 74*c*. The gear holding lever 74 is constituted such that at least the lever portion 74*c* can be elastically deformed by external force applied through the rotation of the cleaner driving lever 73 in a state in which the stopper engagement portions 74C and 74D are engaged with the stoppers 53*c* and 53*d*. Consequently, in the case in which the rotation of the gear holding lever 74 is stopped and the cleaner driving lever 73 is rotated, a shock caused by the engagement of the planetary gear 78 and the inside gear 77 is absorbed.

In the structure described above, when the sun gear 72 (the driving shaft 43) is started to be rotated in a forward direction (a counterclockwise direction) in the wiper reset state shown in FIG. 14, the rotating force is transmitted to the gear holding lever 74 through the planetary gear 78 so that the gear holding lever 74 is rotated in the counterclockwise direction (a direction of an arrow e).

In this case, when the gear holding lever 74 is rotated in the direction of the arrow e, the stopper engagement portion 74D separates from the stopper 53*d*.

In the state in which the rotation of the sun gear 72 is started, the engagement of the planetary gear 78 and the inside gear 77 is released. Therefore, the cleaner driving lever 73 does not receive driving force from the sun gear 72 and is maintained to be stopped in a rotation start position as shown in FIG. 14.

Moreover, the driving pin 75 and the slide pin 122*b* are positioned on the start end (upper end) of the concave groove 122*d* and the start end (left end) of the concave groove 53*a* respectively, and the fixing pin 53*b* is positioned on the start end (right end) of the concave groove 122*c*.

When the sun gear 72 is rotated in the counterclockwise direction, the gear holding lever 74 is further rotated in the direction of the arrow e so that the stopper engagement portion 74C is engaged with the stopper 53*c* and is provided in a rotation stop position on either side.

In this case, when the gear holding lever 74 is rotated in the direction of the arrow e, the planetary gear 78 is mated with the inside gear 77 and is rolled over the inside gear 77 with a rotation in a clockwise direction. For this reason, the cleaner driving lever 73 is not rotated in the direction of an arrow f (a direction in which the wiping device 11 advances) until the stopper engagement portion 74C is engaged with the stopper 53*c*.

When the sun gear 72 is further rotated in the counterclockwise direction in this state, that is, in the state in which the stopper engagement portion 74C is engaged with the stopper 53*c*, the planetary gear 78 is rotated in the clockwise direction so that the cleaner driving lever 73 is started to be rotated in the clockwise direction (the direction of the arrow f).

In this case, the rotating force is transmitted from the sun gear 72 to the gear holding lever 74 through the planetary gear 78. However, since the stopper engagement portion 74C of the lever portion 74*b* is engaged with the stopper 53*c*, the gear holding lever 74 is not rotated in the counterclockwise direction (the direction of the arrow e).

For this reason, when the rotating force is transmitted from the sun gear 72 to the gear holding lever 74 through the planetary gear 78, the lever portion 74*c* is flexed in such a direction as to approach the lever portion 74*b*.

When the sun gear 72 is still rotated in the counterclockwise direction, the planetary gear 78 is further rotated in the clockwise direction and the cleaner driving lever 73 is rotated in the direction of the arrow f.

Figure 16C:
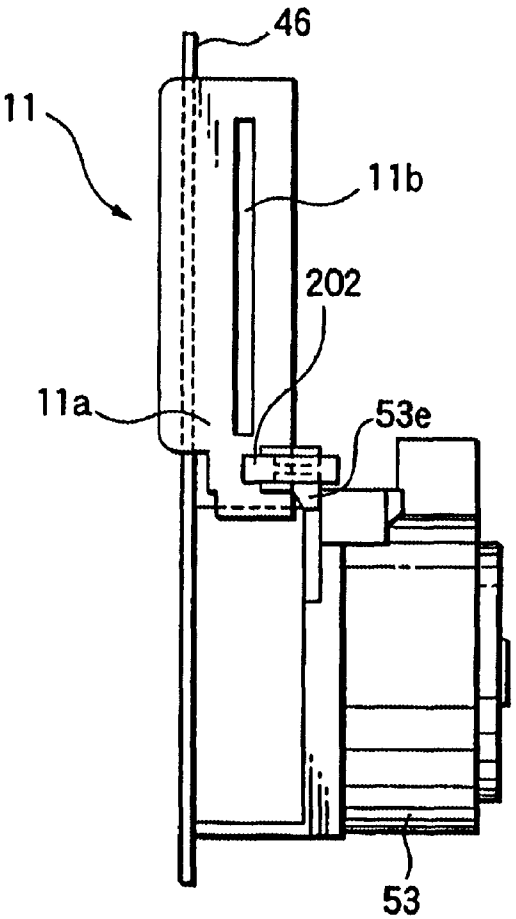
FIGS. 16A to 16C are plan views illustrating the operation of the wiping device in the ink jet recording apparatus according to the fifth embodiment of the invention.
Figure 16B:
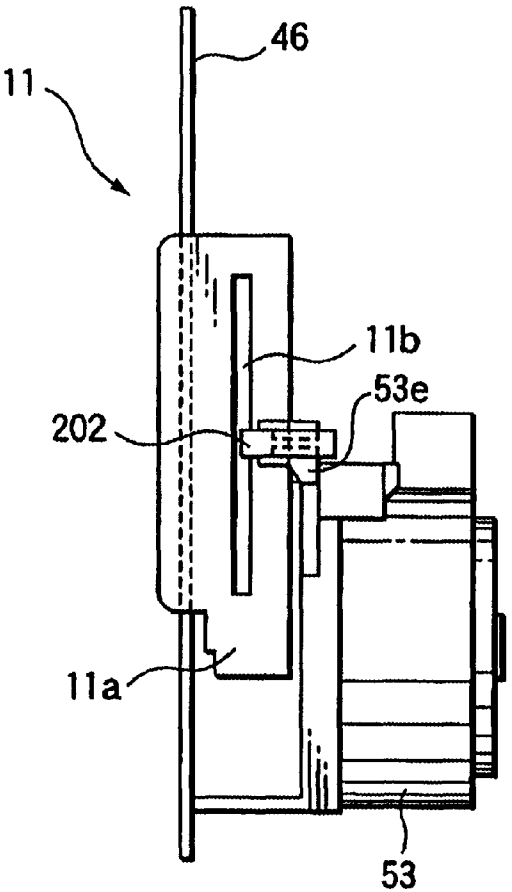
Figure 16A:
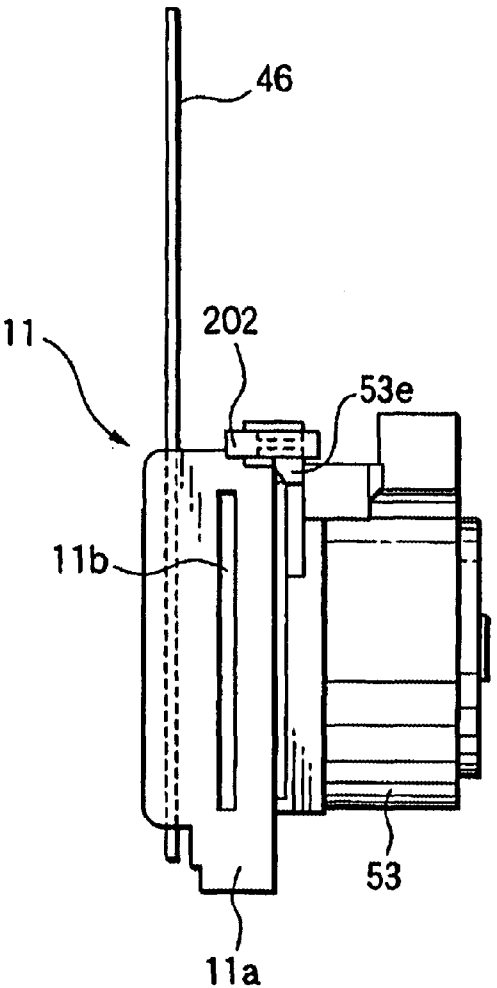

In this case, the wiping device 11 is moved from a position shown in FIG. 16A to a position shown in FIG. 16C through a position shown in FIG. 16B and advances from the outside of the moving path for the recording head 15 to the inside of the moving path in the direction of an arrow g in FIG. 13A and the nozzle forming surface is wiped with the movement of the recording head 15.

When the wiping device 11 advances into the moving path for the recording head 15 (the cleaner driving lever 73 is rotated from the rotation start position by 66 degrees in the clockwise direction), the lever portion 74*c* of the gear holding lever 74 is elastically returned as shown in FIG. 13 so that the engagement of the planetary gear 78 and the inside gear 77 is released. For this reason, the cleaner driving lever 73 does not receive driving force from the sun gear 72 but is provided in the rotation end position.

Moreover, the driving pin 75 is moved from the start end (upper end) of the concave groove 122*d* and is positioned on the terminal end (lower end), and the slide pin 122*b* is moved from the start end (left end) of the concave groove 53*a* and is positioned on the terminal end (right end). Moreover, the fixing pin 53*b* is positioned on the terminal end (left end) of the concave groove 122*c*.

On the other hand, when the sun gear 72 (the driving shaft 43) is started to be rotated in a reverse direction (the clockwise direction) in the wiper set state shown in FIG. 13, the rotating force is transmitted to the gear holding lever 74 through the planetary gear 78 so that the gear holding lever 74 is rotated in the clockwise direction (the direction of the arrow f)

In this case, when the gear holding lever 74 is rotated in the direction of the arrow f, the stopper engagement portion 74C separates from the stopper 53*c*.

In the rotation starting state of the sun gear 72, the engagement of the planetary gear 78 and the inside gear 77 is released. Therefore, the cleaner driving lever 73 does not receive the driving force from the sun gear 72 but is maintained to be stopped in the rotation end position as shown in FIG. 13.

Moreover, the driving pin 75 and the slide pin 122*b* are positioned on the terminal end (lower end) of the concave groove 122*d* and the terminal end (right end) of the concave groove 53*a* respectively, and the fixing pin 53*b* is positioned on the terminal end (left end) of the concave groove 122*c*.

When the sun gear 72 is rotated in the clockwise direction, the gear holding lever 74 is further rotated in the direction of the arrow f so that the stopper engagement portion 74D is engaged with the stopper 53*d* and is provided in the rotation stop position on the other side.

In this case, when the gear holding lever 74 is rotated in the direction of the arrow f, the planetary gear 78 is mated with the inside gear 77 and is rolled over the inside gear 77 with a rotation in the counterclockwise direction. For this reason, the cleaner driving lever 73 is not rotated in the direction of the arrow e (in a direction in which the wiping device 11 retreats) until the stopper engagement portion 74D is engaged with the stopper 53*d*.

When the sun gear 72 is further rotated in the clockwise direction in this state, that is, in the state in which the stopper engagement portion 74D is engaged with the stopper 53*d,* the planetary gear 78 is rotated in the counterclockwise direction so that the cleaner driving lever 73 is started to be rotated in the counterclockwise direction (the direction of the arrow e).

In this case, the rotating force is transmitted from the sun gear 72 to the gear holding lever 74 through the planetary gear 78. However, since the stopper engagement portion 74D of the lever portion 74*b* is engaged with the stopper 53*d,* the gear holding lever 74 is not rotated in the direction of the arrow f. For this reason, when the rotating force is transmitted from the sun gear 72 to the gear holding lever 74 through the planetary gear 78, the lever portion 74*c* is flexed in such a direction as to separate from the lever portion 74*b.*

When the sun gear 72 is further rotated in the clockwise direction, the planetary gear 78 is further rotated in the counterclockwise direction and the cleaner driving lever 73 is rotated in the direction of the arrow e.

In this case, the wiping device 11 is moved from the position shown in FIG. 16C to the position shown in FIG. 16C through the position shown in FIG. 16B and retreats from the inside of the moving path for the recording head 15 to the outside of the moving path in the direction of an arrow h in FIG. 14.

When the wiping device 11 retreats to the outside of the moving path for the recording head 15 (the cleaner driving lever 73 is rotated from a rotation end position by 66 degrees in the counterclockwise direction), the lever portion 74*c* of the gear holding lever 74 is elastically returned as shown in FIG. 14 so that the engagement of the planetary gear 78 and the inside gear 77 is released. For this reason, the cleaner driving lever 73 does not receive driving force from the sun gear 72 but is provided in the rotation start position.

When the wiping device 11 separates from the recording head 15 by the retreating operation, the recording head 15 is moved from the cleaner position to the print region side. More specifically, immediately before the recording head 15 passes through the cleaning position in the moving path, the engagement of the planetary gear 78 and the inside gear 77 is released and the cleaning operation is thus ended.

Moreover, the driving pin 75 is moved from the terminal end (lower end) of the concave groove 122*d* and is positioned on the start end (upper end), and the slide pin 122*b* is moved from the terminal end (right end) of the concave groove 53*a* and is positioned on the start end (left end). Moreover, the fixing pin 53*b* is positioned on the start end (right end) of the concave groove 122*c.*

In the embodiment, accordingly, the waste ink sticking to the wiping member 11*b* is wiped away by the wiper cleaner 202. Therefore, the reliability of the operation of the capping device can be enhanced in the same manner as in the first to fourth embodiments and the generation of contamination in the apparatus can be reduced.

Moreover, the wiper cleaner 202 is moved in the plane direction of the wiping member 11*b.* Therefore, it is possible to remove the waste ink sticking to the wiping member 11*b* while suppressing the scatter.

In the embodiment, furthermore, the waste ink is wiped away by means of the wiper cleaner 202 so that thickened and coagulated substances do not enter the nozzle opening. Therefore, it is possible to prevent the generation of printing failures in the same manner as in the first to fourth embodiments.

While the case in which the wiper cleaner 202 is provided in the pump frame 53 has been described in the embodiment (fifth embodiment), the invention is not restricted thereto but the wiper cleaner 202 may be provided on a wiper cover (not shown). In brief, it is preferable that the wiper cleaner 202 should be provided in such a position that the ink wiping portion of the wiping member 11*b* can be cleaned during the advance and retreat of the wiping device 11.

As is apparent from the above description, according to the ink jet recording apparatus employing the cleaning control method for the wiping device in accordance with the invention, the wiping device is constituted such that it can advance to and retreat from the moving path for the recording head and the wiper cleaner for abutting on the wiping device in slidable contact with the advance and retreat operations of the wiping device is provided. Therefore, it is possible to effectively remove the waste ink sticking to the wiping device with the cleaning operation, for example. Accordingly, it is possible to effectively avoid a problem in that the thickened substance enters the nozzle opening and the ink drop is discharged from the nozzle opening with difficulty in the case in which the waste ink sticking to the wiping device is thickened and the wiping operation is carried out again.

What is claimed is:

1. An ink jet recording apparatus comprising:

an ink jet recording head mounted on a carriage being reciprocated and serving to discharge an ink drop corresponding to print data;

a capping device for sealing a nozzle forming surface of the recording head and sucking and discharging an ink from the recording head upon receipt of a negative pressure from a sucking pump;

a wiping device for cleaning the nozzle forming surface in slidable contact with the nozzle forming of the recording head, the wiping device advancing to and retreating from a moving path for the recording head; and a wiper cleaner for abutting on the wiping device and moving in a plane direction of the wiping device with advance and retreat operations of the wiping device, thereby removing a waste ink sticking to the wiping device, wherein the wiper cleaner is formed in the capping device and is molded integrally with a cap member carrying out sealing in abutment on the nozzle forming surface of the recording head.

2. An ink jet recording apparatus according to claim 1, wherein the wiper cleaner is provided on a print region side in the capping device.

3. An ink jet recording apparatus according to claim 1, wherein the wiping device advances and retreats in a direction orthogonal to the nozzle forming surface of the recording head with respect to the moving path for the recording head and is abutted with the wiper cleaner when retreating from the moving path for the recording head.

4. An ink jet recording apparatus according to claim 1, wherein the wiper cleaner is constituted by an elastic material.

5. An ink jet recording apparatus according to claim 1, wherein the wiper cleaner is constituted by a material capable of absorbing the waste ink.

6. An ink jet recording apparatus according to claim 1, wherein the wiping device is so constituted as to advance and retreat in a horizontal direction perpendicular to the moving path for the recording head.

7. An ink jet recording apparatus according to claim 1, wherein the wiper cleaner is provided in the vicinity of an advance and retreat path for the wiping device.

8. An ink jet recording apparatus comprising:

an ink jet recording head mounted on a carriage being reciprocated and serving to discharge an ink drop corresponding to print data;

a capping device for sealing a nozzle forming surface of the recording head and sucking and discharging an ink from the recording head upon receipt of a negative pressure from a sucking pump;

a wiping device for cleaning the nozzle forming surface in slidable contact with the nozzle forming of the recording head, the wiping device advancing to and retreating from a moving path for the recording head; and a wiper cleaner for abutting on the wiping device and moving in a plane direction of the wiping device with advance and retreat operations of the wiping device, thereby removing a waste ink sticking to the wiping device, wherein a concave portion constituting a box-shaped space is formed between a cap member formed in the capping device and carrying out sealing in abutment on the nozzle forming surface of the recording head and the wiper cleaner provided in the capping device, and a through hole is formed in a lower bottom part of the concave portion and a discharge pipe is protruded downward to surround the through hole.

9. An ink jet recording apparatus according to claim 8, wherein the wiper cleaner is provided on a print region side in the capping device.

10. An ink jet recording apparatus according to claim 8, wherein the wiping device advances and retreats in a direction orthogonal to the nozzle forming surface of the recording head with respect to the moving path for the recording head and is abutted with the wiper cleaner when retreating from the moving path for the recording head.

11. An ink jet recording apparatus according to claim 8, wherein the wiper cleaner is constituted by an elastic material.

12. An ink jet recording apparatus according to claim 8, wherein the wiper cleaner is constituted by a material capable of absorbing the waste ink.

13. An ink jet recording apparatus according to claim 8, wherein the wiping device is so constituted as to advance and retreat in a horizontal direction perpendicular to the moving path for the recording head.

14. An ink jet recording apparatus according to claim 8, wherein the wiper cleaner is provided in the vicinity of an advance and retreat path for the wiping device.

15. An ink jet recording apparatus comprising:

an ink jet recording head mounted on a carriage being reciprocated and serving to discharge an ink drop corresponding to print data;

a capping device for sealing a nozzle forming surface of the recording head and sucking and discharging an ink from the recording head upon receipt of a negative pressure from a sucking pump;

a wiping device for cleaning the nozzle forming surface in slidable contact with the nozzle forming of the recording head, the wiping device advancing to and retreating from a moving path for the recording head; and a wiper cleaner for abutting on the wiping device and moving in a plane direction of the wiping device with advance and retreat operations of the wiping device, thereby removing a waste ink sticking to the wiping device, wherein the capping device is provided with a housing portion of the wiper cleaner constituting a box-shaped space portion on a print region side thereof and a part of the wiper cleaner accommodated in the housing portion is protruded in a horizontal direction so as to abut on the wiping device.

16. An ink jet recording apparatus according to claim 15, wherein a through hole is formed in a lower bottom part of the housing portion of the wiper cleaner and a discharge pipe is protruded downward to surround the through hole.

17. An ink jet recording apparatus according to claim 15, wherein the wiper cleaner is provided on the print region side in the capping device.

18. An ink jet recording apparatus according to claim 15, wherein the wiping device advances and retreats in a direction orthogonal to the nozzle forming surface of the recording head with respect to the moving path for the recording head and is abutted with the wiper cleaner when retreating from the moving path for the recording head.

19. An ink jet recording apparatus according to claim 15, wherein the wiper cleaner is constituted by an elastic material.

20. An ink jet recording apparatus according to claim 15, wherein the wiper cleaner is constituted by a material capable of absorbing the waste ink.

21. An ink jet recording apparatus according to claim 15, wherein the wiping device is so constituted as to advance and retreat in a horizontal direction perpendicular to the moving path for the recording head.

22. An ink jet recording apparatus according to claim 15, wherein the wiper cleaner is provided in the vicinity of an advance and retreat path for the wiping device.

23. An ink jet recording apparatus comprising:

an ink jet recording head mounted on a carnage being reciprocated and serving to discharge an ink drop corresponding to print data;

a capping device for sealing a nozzle forming surface of the recording head and sucking and discharging an ink from the recording head upon receipt of a negative pressure from a sucking pump;

a wiping device for cleaning the nozzle forming surface in slidable contact with the nozzle forming of the recording head, the wiping device advancing to and retreating from a moving path for the recording head; and a wiper cleaner for abutting on the wiping device and moving in a plane direction of the wiping device with advance and retreat operations of the wiping device, thereby removing a waste ink sticking to the wiping device, wherein the wiper cleaner is provided on a frame of the sucking pump.

24. An ink jet recording apparatus comprising:

an ink jet recording head mounted on a carriage being reciprocated and serving to discharge an ink drop corresponding to print data;

a capping device for sealing a nozzle forming surface of the recording head and sucking and discharging an ink from the recording head upon receipt of a negative pressure from a sucking pump;

a wiping device for cleaning the nozzle forming surface in slidable contact with the nozzle forming of the recording head, the wiping device advancing to and retreating from a moving path for the recording head; and a wiper cleaner for abutting on the wiping device and moving in a plane direction of the wiping device with advance and retreat operations of the wiping device, thereby removing a waste ink sticking to the wiping device, wherein a driving mechanism of the wiping device is constituted by a cam mechanism having a pump driving shaft for driving the sucking pump and a gear device to be driven by a rotation of the pump driving shaft.

25. An ink jet recording apparatus according to claim 24, wherein the driving mechanism is constituted by a driving mechanism for applying, to the wiping device, such driving force as to advance to the moving path by a rotation in a sucking direction of the pump driving shaft and to retreat from the moving path by a rotation in an opposite direction to the sucking direction.

26. A cleaning control method for a wiping member in an ink jet recording apparatus comprising an ink jet recording head mounted on a carriage being reciprocated and serving to discharge an ink drop corresponding to print data, a capping device for sealing a nozzle forming surface of the recording head and sucking and discharging an ink from the recording head upon receipt of a negative pressure from a sucking pump, and a wiping device for cleaning the nozzle forming surface in slidable contact with the nozzle forming surface of the recording head, comprising the steps of:

causing the wiping device to advance to a moving path for the recording head into a wiper set state with the nozzle forming surface of the recording head sealed by the capping device;

causing a wiper cleaner provided in the capping device to abut on the wiping device in the set state with the nozzle forming surface of the recording head unsealed from the capping device;

causing the wiping device to slidably come in contact with the nozzle forming surface with a movement of the recording head toward a print region side; and causing the wiping device to retreat from the moving path for the recording head with the wiper cleaner abutting on the wiping device, and removing a waste ink sticking to the wiping device through the wiper cleaner.

27. A cleaning control method for the wiping member in the ink jet recording apparatus according to claim 26, further comprising the step of applying a negative pressure into the capping device through the sucking pump, thereby sucking and discharging an ink from the recording head with the nozzle forming surface of the recording head sealed by the capping device.

* * * * *